US010899590B2

(12) United States Patent
Kukula et al.

(10) Patent No.: US 10,899,590 B2
(45) Date of Patent: Jan. 26, 2021

(54) WINCH FOR A VEHICLE HAVING DAMAGE PROTECTION

(71) Applicant: Polaris Industries Inc., Medina, MN (US)

(72) Inventors: Glen L. Kukula, Fullerton, CA (US); Hitesh R. Patel, Anaheim, CA (US)

(73) Assignee: Polaris Industries Inc., Medina, MN (US)

( * ) Notice: Subject to any disclaimer, the term of this patent is extended or adjusted under 35 U.S.C. 154(b) by 81 days.

(21) Appl. No.: 16/174,399

(22) Filed: Oct. 30, 2018

(65) Prior Publication Data

US 2020/0131010 A1 Apr. 30, 2020

(51) Int. Cl.

| | |
|---|---|
| ***B66D 1/28*** | (2006.01) |
| ***B66D 1/12*** | (2006.01) |
| ***B66D 1/16*** | (2006.01) |

(52) U.S. Cl.

CPC ..... *B66D 1/28* (2013.01); *B66D 1/12* (2013.01); *B66D 1/16* (2013.01); *B66D 2700/0183* (2013.01)

(58) Field of Classification Search

CPC .. B66D 1/12–16; B66D 1/20–24; B66D 1/28; B66D 3/006; B66D 3/20; B66D 3/26; B66D 2700/0183

See application file for complete search history.

(56) References Cited

U.S. PATENT DOCUMENTS

| | | | | |
|---|---|---|---|---|
| 2,496,754 A | | 2/1950 | Schramm et al. | |
| 4,650,163 A | | 3/1987 | Peterson | |
| 4,736,929 A | | 4/1988 | McMorris | |
| 5,072,962 A | * | 12/1991 | Webb | B60D 1/58 254/323 |
| 9,463,964 B2 | | 10/2016 | Heravi et al. | |
| 2015/0307332 A1 | * | 10/2015 | Huang | B66D 1/28 254/323 |
| 2016/0167935 A1 | * | 6/2016 | Fretz | B66D 1/22 254/344 |
| 2018/0127246 A1 | | 5/2018 | Fretz et al. | |
| 2018/0201488 A1 | | 7/2018 | Zheng | |
| 2018/0273357 A1 | * | 9/2018 | Huang | B66D 1/00 |

FOREIGN PATENT DOCUMENTS

| | | | | |
|---|---|---|---|---|
| CN | 204 573 608 U | | 8/2015 | |
| EP | 1 598 305 A2 | | 11/2005 | |
| GB | 2537890 A | * | 11/2016 | B66D 1/00 |

OTHER PUBLICATIONS

International Search Report and Written Opinion dated Feb. 4, 2020 in corresponding PCT Application No. PCT/US2019/058705.

* cited by examiner

*Primary Examiner* — Sang K Kim
*Assistant Examiner* — Nathaniel L Adams
(74) *Attorney, Agent, or Firm* — Harness Dickey

(57) ABSTRACT

A winch and method for operating the winch includes a winch body having a first drum support, a second drum support and a drum rotatably coupled to the first drum support and the second drum support. The winch further comprises a plurality of gears coupled to the second drum support and the drum. A motor is coupled to the drum through the plurality of gears. A motor cover is coupled to the first drum support. A gear cover is coupled to the second drum support and houses the plurality of gears therein. A supplemental cover covers at least a portion of the motor cover or a portion of the gear cover or both.

11 Claims, 27 Drawing Sheets

WINCH FOR A VEHICLE HAVING DAMAGE PROTECTION

FIELD

The present disclosure relates to a winch and, more particularly, to a winch having improvements to protection and functionality.

BACKGROUND

This section provides background information related to the present disclosure which is not necessarily prior art.

Winches are used for many purposes. Winches have a drum that rotates to tighten a line or cable attached thereto. The drum, upon rotation, pulls the cable or rope and winds the cable or rope around the drum.

One use for a winch is in off-roading. Off-road vehicles may be placed in difficult positions due to the terrain. To remove the vehicle from the difficult position, a winch may be used to pull the vehicle in a desired direction and out of the difficult position so the vehicle can continue travelling. When in an undesirable position, the rope or cable is secured around a stationary object and the winch rotates to pull the vehicle in the desired direction.

The winch may also be used to pull another vehicle from an undesirable position. Because winches are used in a hostile environment, damage to the winch may occur. An electric or hydraulic winch has control parts such as motor and a transmission or set of gears that operate the winch. Damage to those components may render the winch unusable. Therefore, prevention of damage to the winch is desirable.

SUMMARY

This section provides a general summary of the disclosures, and is not a comprehensive disclosure of its full scope or all of its features.

The present disclosure provides improved configurations for a winch having protective and useful features.

In one aspect of the disclosure, a winch includes a winch body having a first drum support, a second drum support and a drum rotatably coupled to the first drum support and the second drum support. The winch further comprises a plurality of gears coupled to the second drum support and the drum. A motor is coupled to the drum through the plurality of gears. A motor cover is coupled to the first drum support. A gear cover is coupled to the second drum support and houses the plurality of gears therein. A supplemental cover covers at least a portion of the motor cover or a portion of the gear cover or both.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

DETAILED DESCRIPTION

Examples will now be described more fully with reference to the accompanying drawings. Although the following description includes several examples of a sport utility vehicle, it is understood that the features herein may be applied to any appropriate vehicle, such as motorcycles, all-terrain vehicles, utility vehicles, moped, scooters, etc. The examples disclosed below are not intended to be exhaustive or to limit the disclosure to the precise forms disclosed in the following detailed description. Rather, the examples are chosen and described so that others skilled in the art may utilize their teachings.

Figure 1:
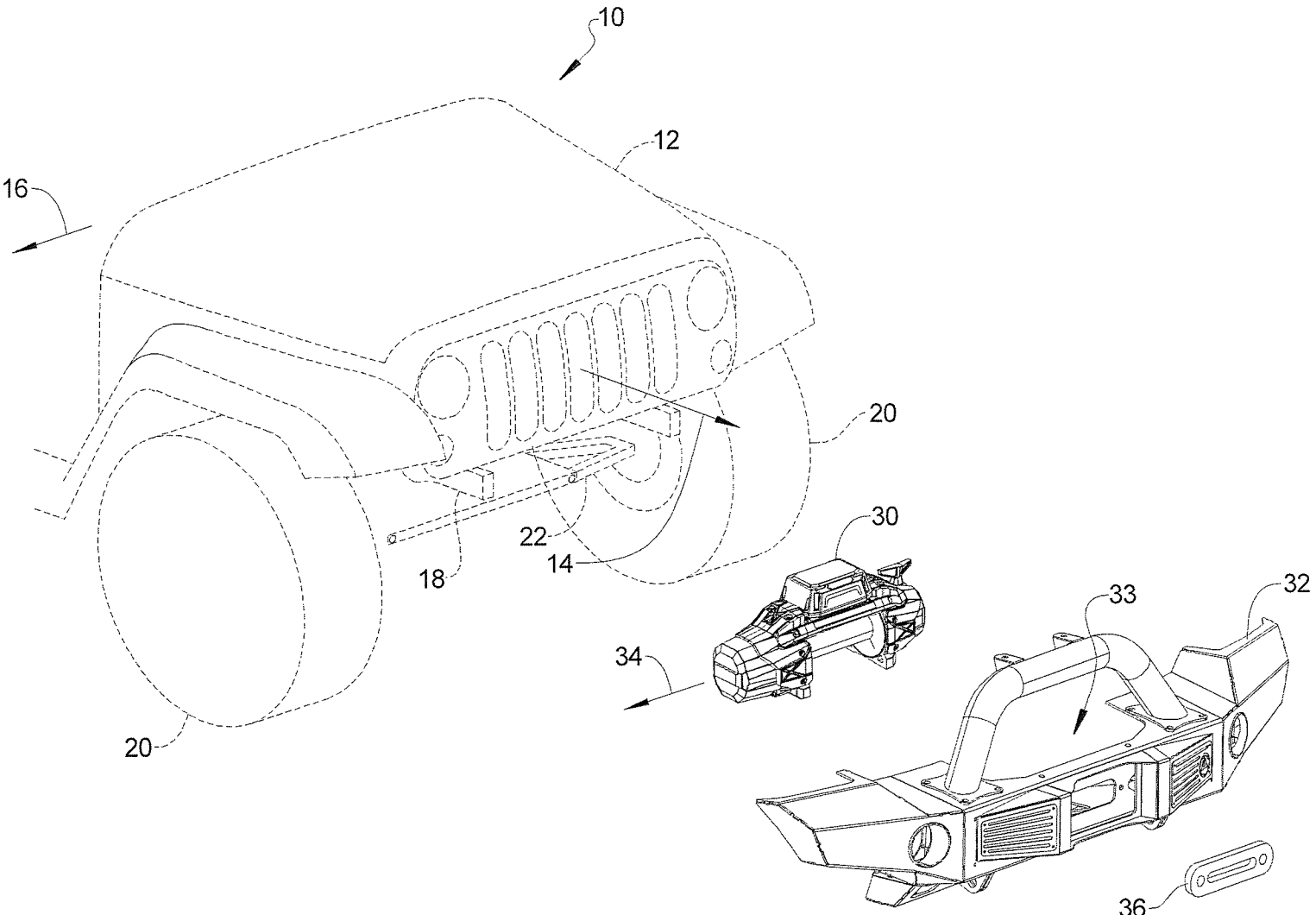
FIG. 1 is a perspective view of a vehicle having a winch according to the present disclosure.

Referring now to FIG. 1, a vehicle 10 has a vehicle body 12 that has a longitudinal axis 14 illustrated by the dot within FIG. 1. The longitudinal axis 14 extends outward from plane of the page. The vehicle body 12 also includes a lateral axis 16 that runs side to side across the vehicle. Lateral axis 16 is illustrated with arrows extending from the vehicle body 12. The vehicle body 12 is mounted to a frame 18. The frame 18 supports the vehicle body 12 and supports the wheels 20. The wheels 20 are coupled to a suspension 22 that allows the wheels 20 to move relative to the frame 18. A winch 30 is illustrated mounted to a bumper 32 or directly to the frame 18. The bumper 32 may be made to receive the winch 30 at least partially within an opening 33 of the bumper 32. As mentioned above, the winch 30 may be used for puffing other vehicles or the vehicle 10 from an undesirable position.

The vehicle 10 is generally orientated so that the front of the vehicle 10 is in a plane that is normal or perpendicular to the longitudinal axis 14. As will be described in more detail below, a winch 30 has a longitudinal axis 34 that is parallel to the lateral axis 16 of the vehicle and is perpendicular to the longitudinal axis 14 of the vehicle 10.

A fairlead 36 may be attached to the bumper 32 and receive and guide the rope or cable from the winch 30.

Figure 2:
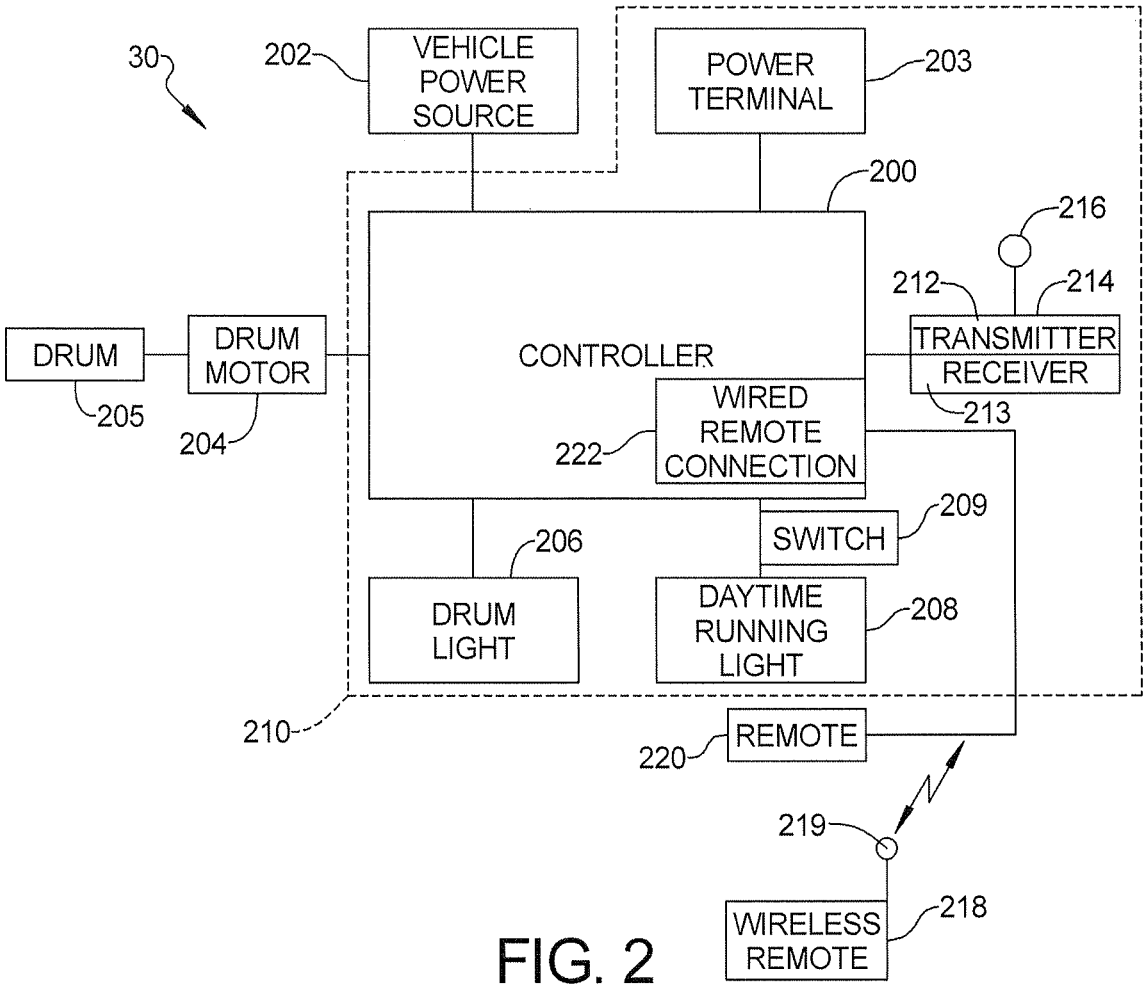
FIG. 2 is a block diagrammatic view of a controller for the winch of FIG. 1.

Referring now to FIG. 2, a block diagrammatic view of the winch 30 is set forth. The winch 30 includes a controller 200. The controller 200 may be microprocessor based or may be formed of discreet circuitry. The controller 200 is in communication with a vehicle power source 202. The vehicle power source 202 may be a battery. However, the vehicle power source 202 may be the vehicle battery in the ignition-on position. A power terminal 203 is used for coupling an external device to a power source at the winch 30.

The controller 200 is used to control a drum motor 204 used for rotating a drum 205 to tighten or release cable or rope attached to the drum 205.

The controller 200 may also be used for controlling various features such as a drum light 206. The drum light 206 will be illustrated in further detail below. The drum light 206 may be an incandescent or light emitting diodes directed to the drum 205 so that the cable or rope may be viewed or visible during operation of the drum 205. The drum light 206 may illuminated when the drum motor 204 is rotating.

A daytime running light 208 may also be controlled by the controller 200. The daytime running light 208 may be coupled to the vehicle power source 202 in the ignition-on position. The daytime running light 208 may also be controlled with an independent switch 209 which may be located within the vehicle 10. The switch 209 may be part of the vehicle 10 and thus when the vehicle lights are activated by the switch 209 the daytime running lights 208 are activated. For example, other daytime running lights within the vehicle 10 may be coupled to the daytime running light 208 of the winch 30. For convenience the switch 209 is located within a contactor box 210. However, if switch 209 may also be included within the vehicle itself.

The contactor box 210 may include various components and is located on a winch body, described below. The contactor box 210 may include the controller 200, the drum light 206, the daytime running light 208 and a transmitter 212 and or a receiver 213, or both. The transmitter 212 and receiver 213 in combination may be referred to as a transceiver 214. The transceiver 214 may be a wireless transceiver or a wired transceiver. The wireless transceiver 214 may include an antenna 216. The antenna 216 communicates with a wireless remote control 218. The wireless remote control 218 may communicate signals through the antenna 219 for activating the winch 30 and for rotating the drum motor 204 in a forward or reverse direction (wind and unwind).

The controller 200 may also have a wired remote control 220 coupled thereto. The wired remote control 220 may be used in place in of the wireless remote control 218. The wired remote control 220 may be connected to a connector 222. By providing the remote controls 218, 220, the winch may be activated from afar and thus the conditions of the vehicle 10 and the winch 30 may be monitored from a safe distance.

Figure 3:
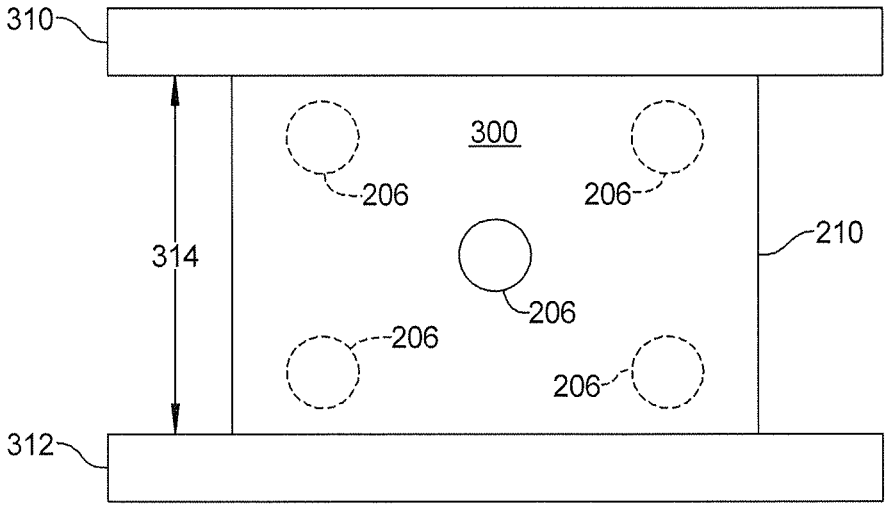
FIG. 3 is a layout of lights on a contactor box.

Referring now to FIG. 3, the underside 300 of the contactor box 210 is illustrated. The controller 200 within the contactor box 210 may be used to operate the drum lights 206. In this example, the drum lights 206 are a plurality of LED lights. One or more LEDs may be used to illuminate the drum 205 of the winch 30. In this example, one drum light 206 is illustrated in solid representing at least one light being used. However, if greater illumination is required, the drum lights 206 may include multiple LEDS in one or more positions such as those illustrated in FIG. 3. The contactor box 210 is mounted to the winch with cross members 310 and 312 as described in further detail below. The cross members 310 and 312 may be spaced apart by a distance 314 to allow the underside 300 of the contactor box 210 to be exposed to the drum there beneath.

Figure 4:
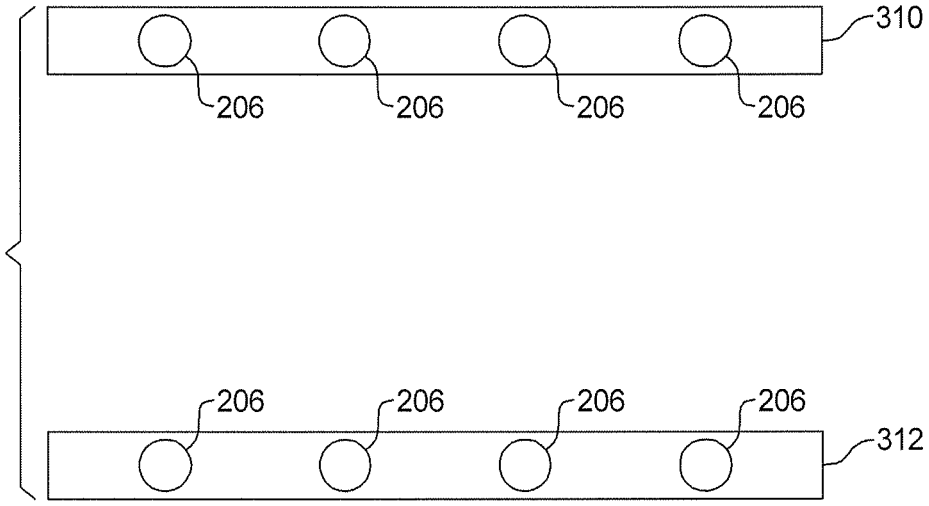
FIG. 4 is a bottom view of the cross members of the winch having drum lights therein.

Referring now to FIG. 4, an alternate configuration for mounting the drum lights 206 is illustrated. In this example, the plurality of drum lights 206 may be spaced apart and positioned on the underside of the cross members 310 and 312. Again, the controller 200 within the contactor box 210 may be used to operate or power the drum lights 206.

Figure 5A:
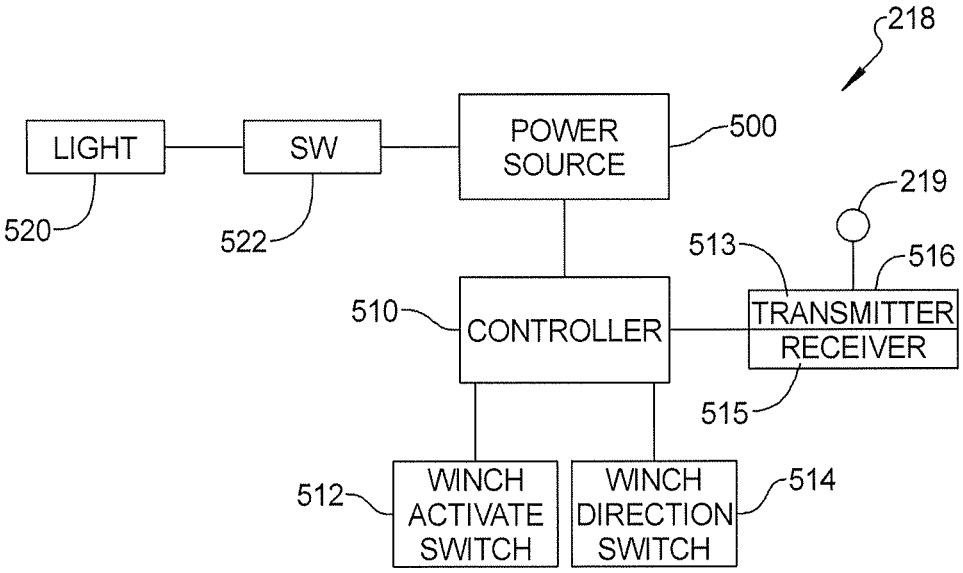
FIG. 5A is a block diagrammatic view of the wireless winch controller.

Referring now to FIG. 5A, the wireless remote control 218 is illustrated in further detail. The wireless remote control 218 may include various components such as a power source 500, a controller 510, a winch activate switch 512 and a winch direction switch 514. The controller 510 may communicate signals to and from the transceiver 214 through a transmitter 513 and a receiver 515 or in combination a transceiver 516. However, the remote control 218 may also include only the transmitter 513. In the following description the transceiver 516 wording will be used, however, it should be understood that only the transmitted may be set forth within the transceiver 516. The transceiver 512 may communicate signals over-the-air through the antenna 514.

The winch activate switch 512 may be used to activate or enable the winch 30 and generate a winch activation signal which is communicated through the transmitter 513 and antenna 219. The winch direction switch 514 may generate a signal corresponding to the desired winch direction. The winch direction may be wind or unwind in relation to the drum 205 of the winch 30. Ultimately the transmitter or transceiver 516 may communicate the drum direction signal to the winch 30 for control of the winch motor.

The power source 500 of the wireless remote 218 may be in communication with a light 520. The light 520 may be coupled to the power source 500 through a switch 522. The light 520 may be used for illuminating the environment around the wireless remote control 210.

Figure 5B:
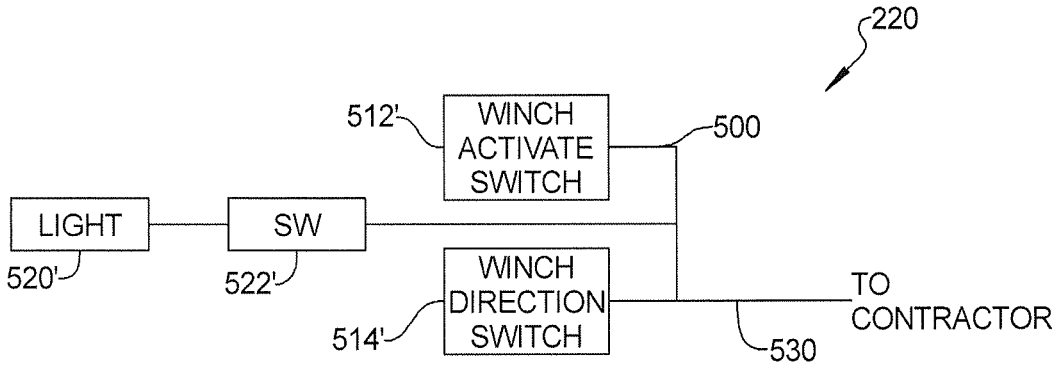
FIG. 5B is block diagrammatic view of the wired winch controller.

Referring now to FIG. 5B, the wired remote 220 is illustrated in further detail. The wired remote 220 may include a wire 530 for transmitting both power and signals from switches from within the wired remote 220. The wire 530 may be a plurality of wires bundled together. In this example, the wire 530 is in communication with various elements such as those illustrated in FIG. 5A. In this example, the switches and components are labeled with a prime to indicate the same functions. That is, in this example, the winch activate switch 512' is in communication with the wire 530. The winch direction switch 514' is also in communication with the wire 530. The switch 522' and the light 520' are also in communication with the wire 530.

Ultimately, the wire 530 communicates the switch signals to the contactor box 210 which in turn allows for the control of the drum motor 204.

Figure 6A:
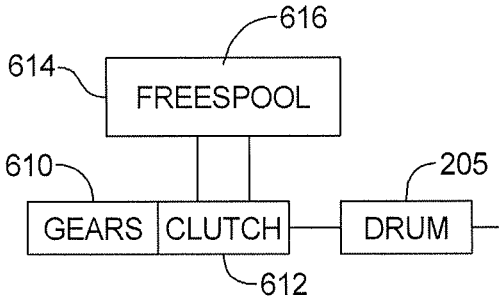
FIG. 6A is a front view of the release handle and the clutch showing first indicia.
Figure 6B:
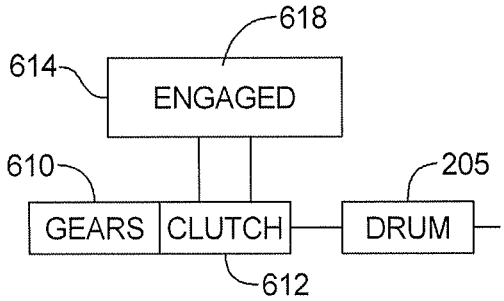
FIG. 6B is a back view of the release handle showing second indicia.

Referring now to FIGS. 6A and 6B, gears 610 are used to communicate forces from the motor to the drum 205. The gears 610 may also be referred to as a transmission or gear set. The gears 610 may be configured in a variety of manners including a planetary gear set or a worm gear set. The gears 610 engage the drum 205 through a clutch 612. The clutch 612 may be manually engaged or disengaged using a release handle 614. The release handle may also be used to disengage gears or the drum from the gears. Simply, the drum is disconnected from the motor.

The release handle 614 may be generally planer in shape and include a first indicia 616 and second indicia 618. In this example the release handle 614 is generally planer and is normal to the longitudinal axis 614 of the vehicle such that the first indicia 616 and the second indicia 618 are facing outward from the body of the vehicle 10 so that the indicia may easily be viewed during the operation of the winch. That is the proper indicia for engaged gears or disengaged ears are forward pacing relative to the vehicle. In FIG. 6A the first indicia 616 states "free spool" which describes the clutch as disengaging the gears and thus the drum 205 of the winch 30 may move in a free manner to allow the cable or rope attached thereto to be pulled while the drum 205 rotates. When the release handle 614 is rotated 180 degrees the second indicia 618 is illustrated to indicate that the clutch 612 is engaged with the gear 610. In this example the word "engaged" is provided as the second indicia 618. Again, the second indicia 618 are disposed on a plane the release handle 614 such that the second indicia 618 is visible during operation. When the first indicia 616 in FIG. 6A are visible, the second indicia 618 is facing the vehicle and can thus not be easily viewed. The operator will view the appropriate first indicia 616 and second indicia 618 standing in front of the winch 30 and the vehicle 10. In front of the vehicle is the normal operating position when using the winch 30. Likewise, when the release handle 614 is rotated and facing the other direction, the second indicia 618 is displayed outward from the vehicle and toward the position away from the vehicle 10. Words are described as the first indicia and the second indicia. The first indicia 616 and the second indicia 618 may be colors or symbols as well.

Referring now to FIGS. 7A-7I, the winch 30 is illustrated in further detail. The winch 30 is comprised of a plurality of high-level components including the drum 205 that is coupled to the drum motor 204. The drum motor 204 has a motor housing 710 that is coupled thereover. The drum 205 is also in communication with the gears 610. The release handle 614 is also illustrated relative to the gear 610. The contactor circuit 712 is illustrated coupled to the cross-member 310 and the cross member 312 as described above.

The drum 205 is supported by a first drum support 720 and a second drum support 722. The drum supports 720 and 722 are extremely strong due to the forces that act on them. For example, the drum supports 720, 722 may be cast. That is, the drum 205 is rotatably coupled to the drum supports 720 and 722. A motor cover 726 is used to cover the motor housing 710 and the motor 204 when assembled. The motor cover 726 may be formed of various materials including plastic or metal. The motor cover 726 is secured to the first drum support 720 by way of a plurality of fasteners but not limited to screws, bolts, clips, hook and loop fasteners and the like.

The second drum support 722 is coupled to a gear cover 730. The gear cover 730 is also fixedly coupled to second drum support using a plurality of fasteners 741 such as but not limited to screws, clips, bolts or hook and loop fasteners. The gear cover 730 incases the gears 610. The release handle 614 may extend from the gear cover 730. Appropriate seals may be used to prevent outside environmental conditions from entering the gear cover and fouling the gears.

A supplemental cover 740 may be used to cover at least a portion of the motor cover 726 and the gear cover 730. The supplemental cover 740, in this example, is formed from a motor side supplemental cover 740A and a gear side supplemental cover 740B. However, although the components are illustrated as separate, the components may joined across the drum 205 as described in FIG. 11. The connection between the covers may be behind, under or around the drum 205. The supplemental cover 740 may be formed from various materials including but not limited to plastic, metal, rubber, metal covered plastic or combinations thereof. The supplemental cover 740 may be referred to as armor to protect the covers beneath it. Also the supplemental cover 740 could be decorative or both decorative and protective. The supplemental cover 740 may be fastened to the motor cover 726, the gear cover 730, the first drum support 720 and the second drum support 722 in various positions using one of the types of fasteners 741 describe above, of which screws are illustrated. As is illustrated best in FIG. 7C, the supplemental cover 740A is coupled to the drum support 720 by fasteners 741 through the holes illustrated. The gear side supplemental cover 740B is coupled to the second drum support 722 also by fasteners 741 through the holes illustrated.

The winch 30 is illustrated having a longitudinal axis 742 and a front side 744. The top side 746 is also illustrated. The rear side (toward the vehicle) is opposite from the front side 744. The bottom side is opposite the top side 746. The winch 30 is mounted at the bottom side.

The motor side supplemental cover 740A extends at least partially covering the top side 746 of the motor cover 726 and the top side of the first drum support 720. The motor side supplemental cover 740A also covers at least a portion of the front side 744 of the motor cover 726. In this example, the motor side supplemental cover 740A extends also partially circumferentially around to cover a portion of the rear side which is opposite the front side 744. In this example the gear side supplemental cover 740B also is coupled to the second drum support 722. The gear side supplemental cover 740B covers at least a portion of the top sides of both the second drum support 722 and the gear cover 730. In this example a portion of the rear side opposite the front side may also be covered by the gear side supplemental cover 740'. In FIG. 8, the gear cover 740B' is fastened to the second drum support 722' and the gear cover 730' by way of fasteners or other types of fastening devices.

The contactor box 720 has a contactor box cover 750. The contactor box cover 750 may have openings or covered openings 752 and 754 for coupling the contactor box 720 to the vehicle power and for providing auxiliary power to other components desired by the user. The covered openings 752 and 754 cover respective connectors 756, 758 that are used to make an electrical connection. A daytime running light 208 may be formed by a separate component or by a translucent shield formed as part of the contactor box cover 750. As mentioned above, daytime running light may be controlled from within the vehicle or outside the vehicle depending upon the desired vehicle configuration.

The contactor box cover 750 may include a lens cover 760 used for covering the daytime running light 208. That is, the lens cover 760 may be a transparent or translucent portion of the contactor box 750 behind which a light source such as the daytime running light 208 may be placed. Thus, when the light is desired to be illuminated it shines through the lens cover 760.

The supplemental covers 740A, 740B may have ribs 754 in various patterns thereon. The ribs 754 may be used to strengthen the cover 740A and 740B and also add rigidity thereto. The ribs 754 may also be used for ornamentation. The supplemental covers 740A, 740B may have various shapes and colors to be aesthetically pleasing.

Figure 7A:
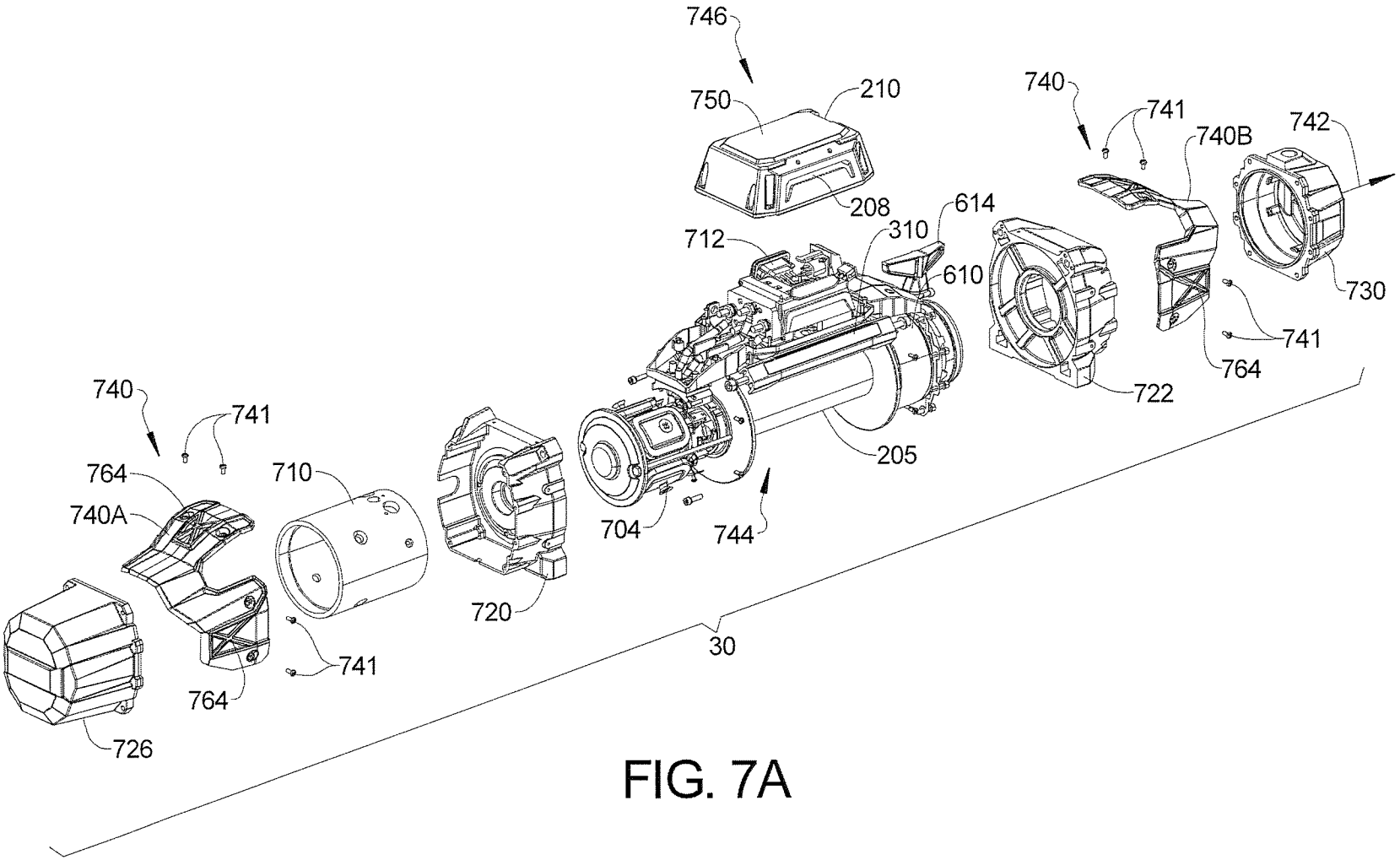
FIG. 7A is a detailed exploded view of a first example of the winch.
Figure 7B:
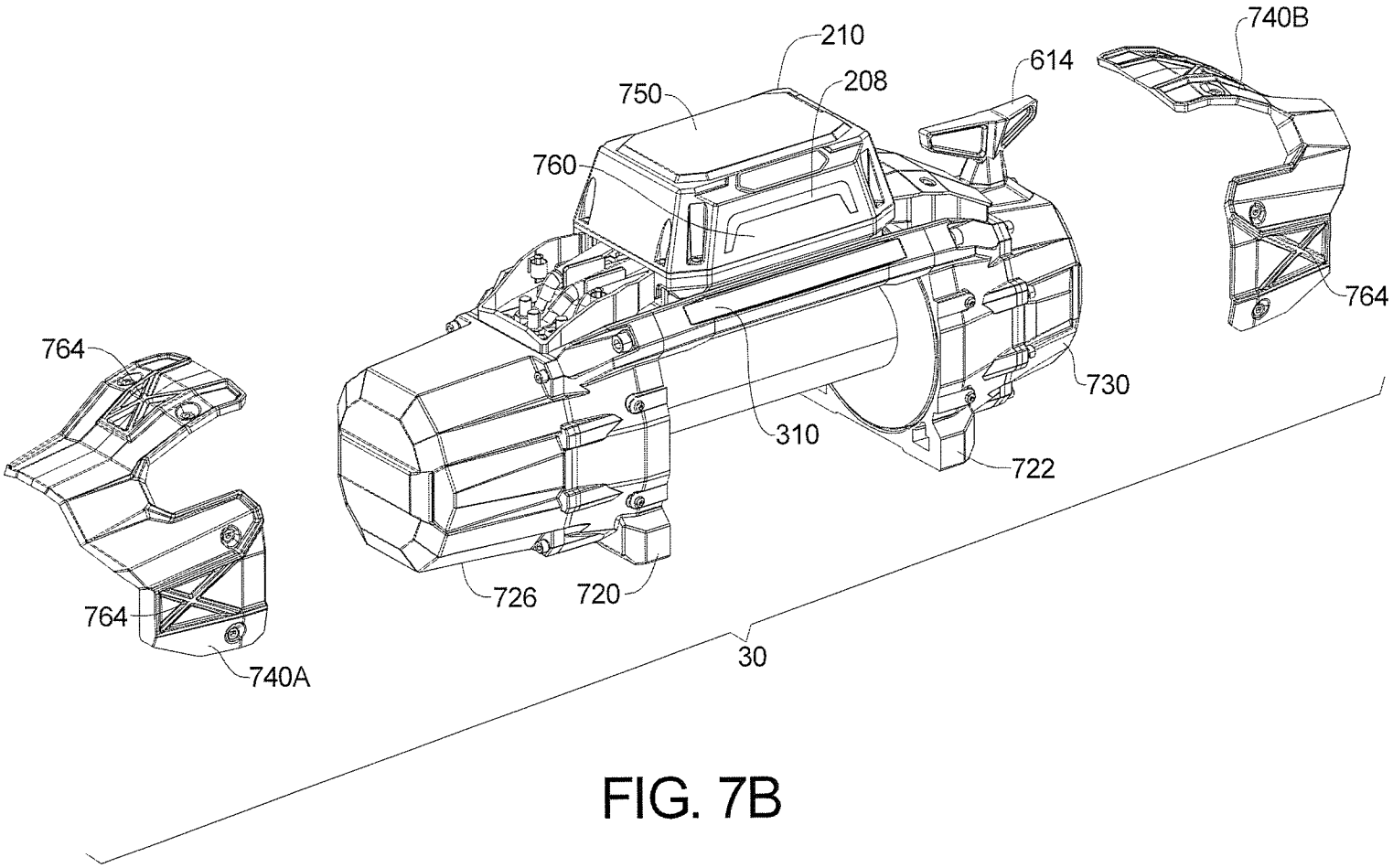
FIG. 7B is a partially exploded view of the winch.
Figure 7C:
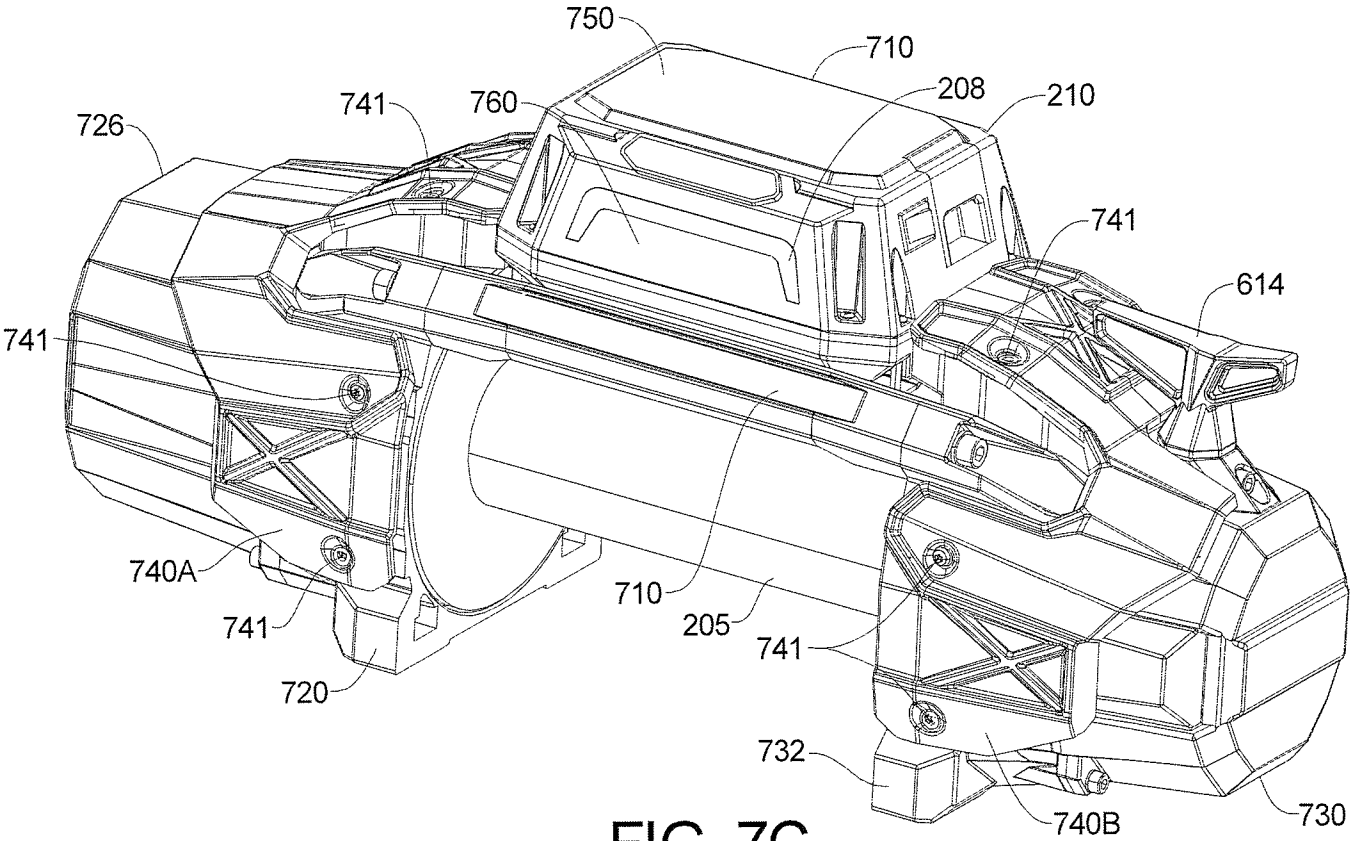
FIG. 7C is a perspective view of the winch of FIG. 7A.
Figure 7D:
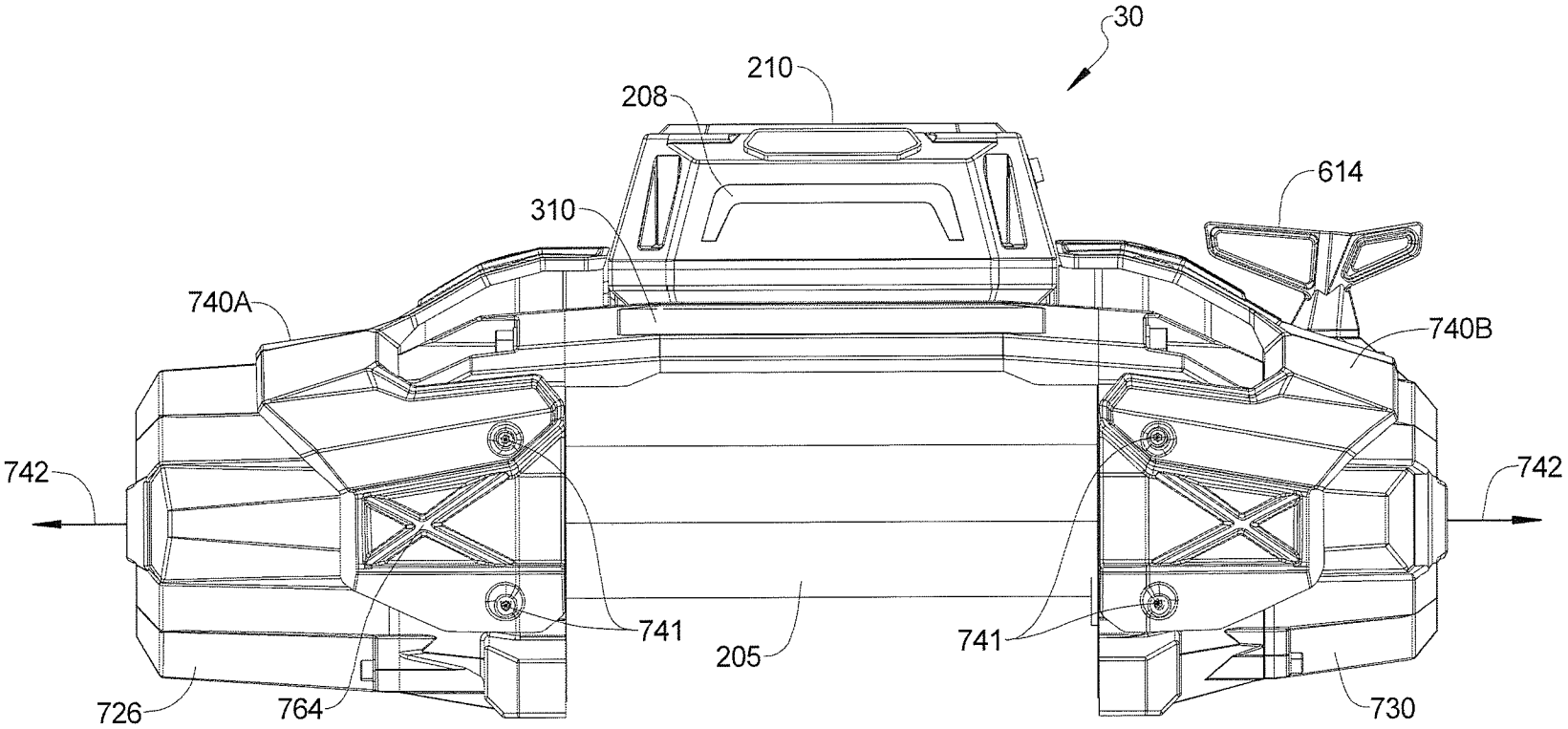
FIG. 7D is a front view of the winch for FIG. 7A.
Figure 7E:
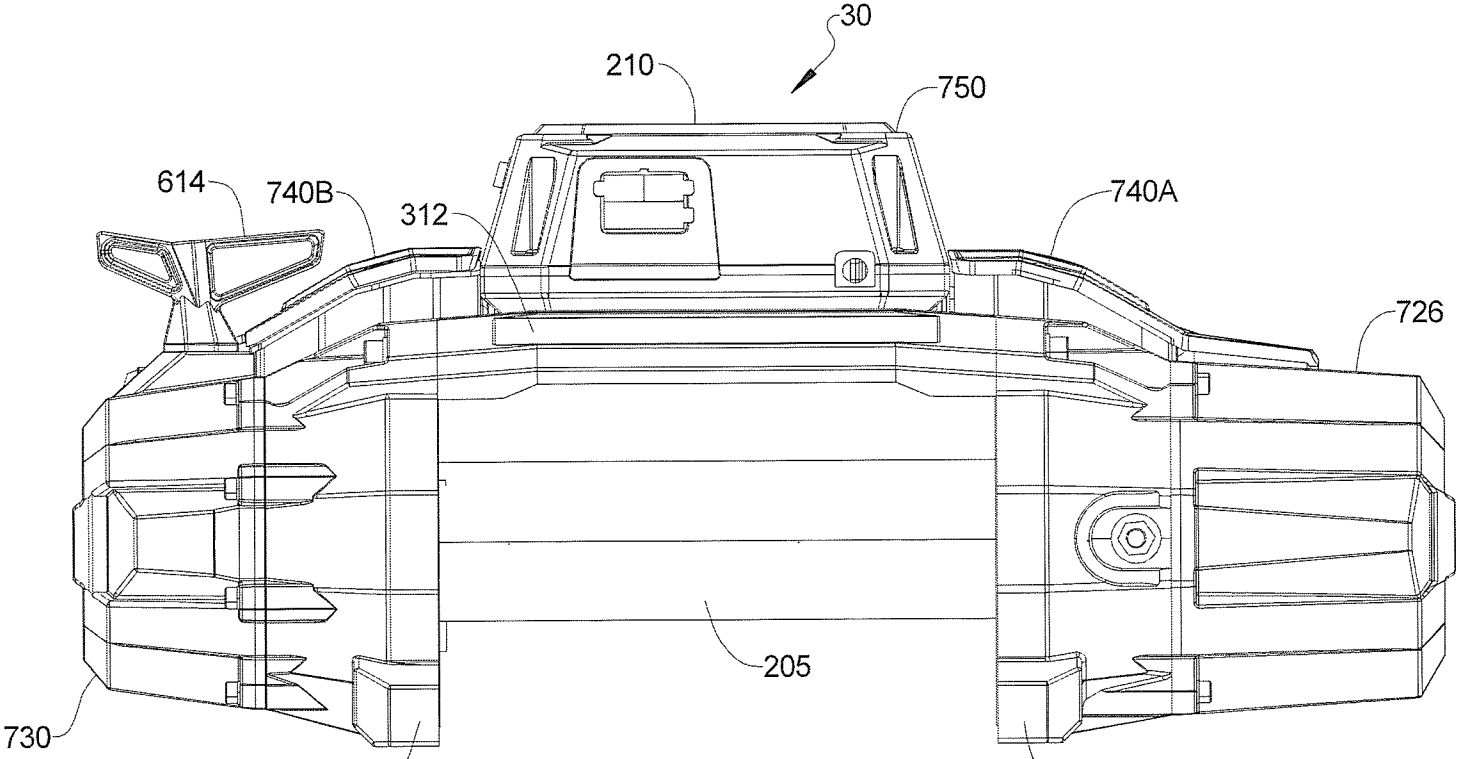
FIG. 7E is a back view of the winch of FIG. 7A.
Figure 7G:
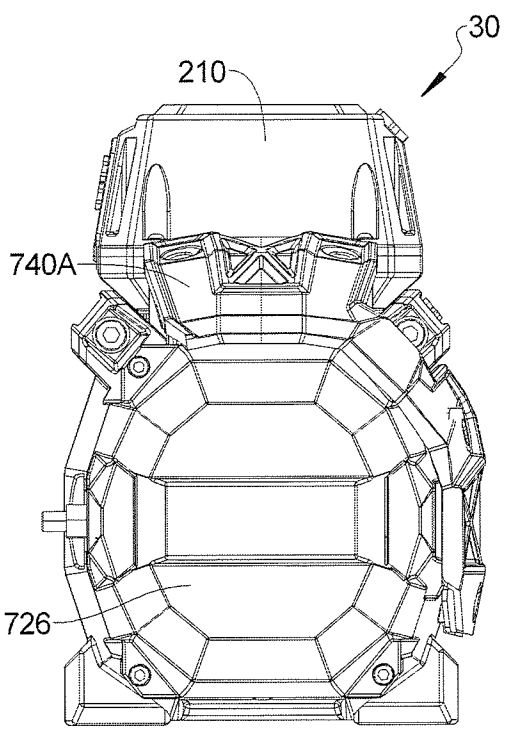
FIG. 7G is a left side view of the winch of FIG. 7A.
Figure 7F:
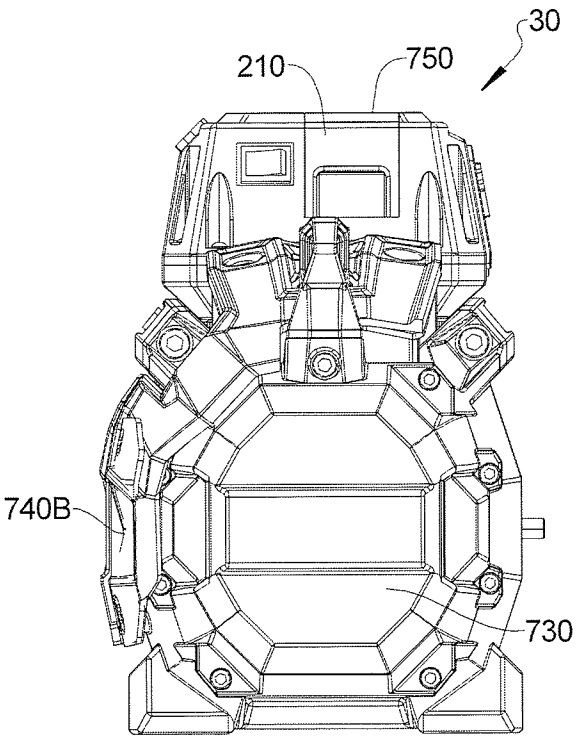
FIG. 7F is a right side view of the winch of FIG. 7A.
Figure 7H:
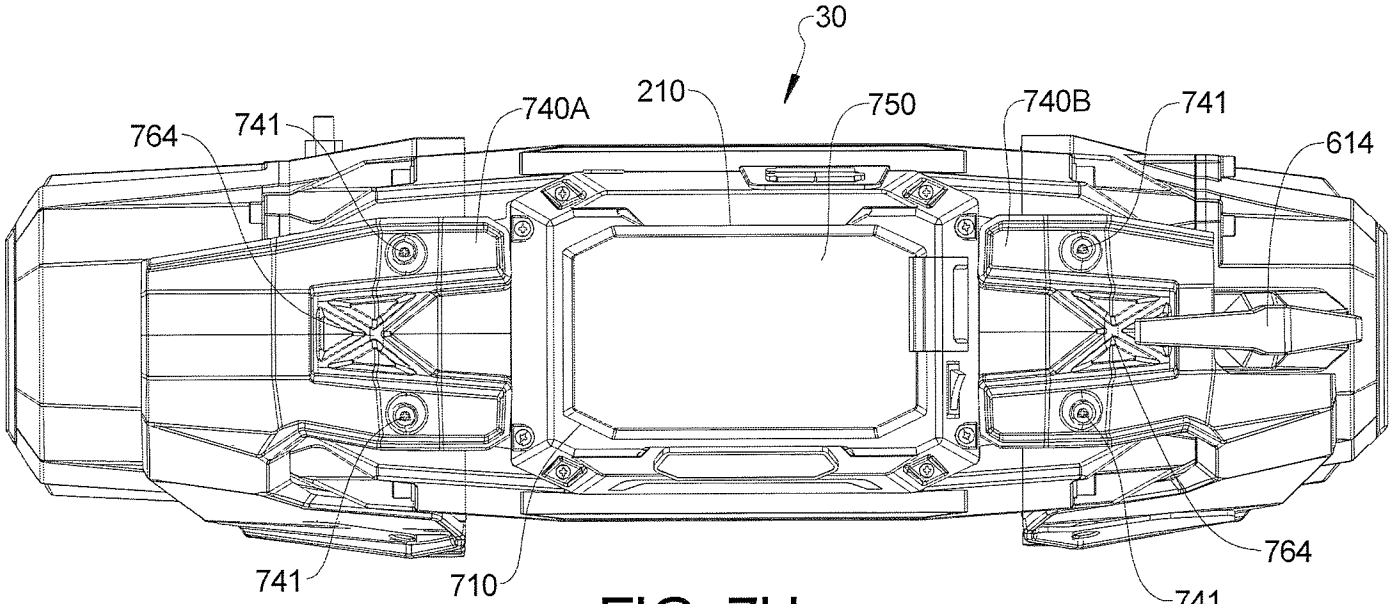
FIG. 7H is a top side view of the winch of FIG. 7A.
Figure 7I:
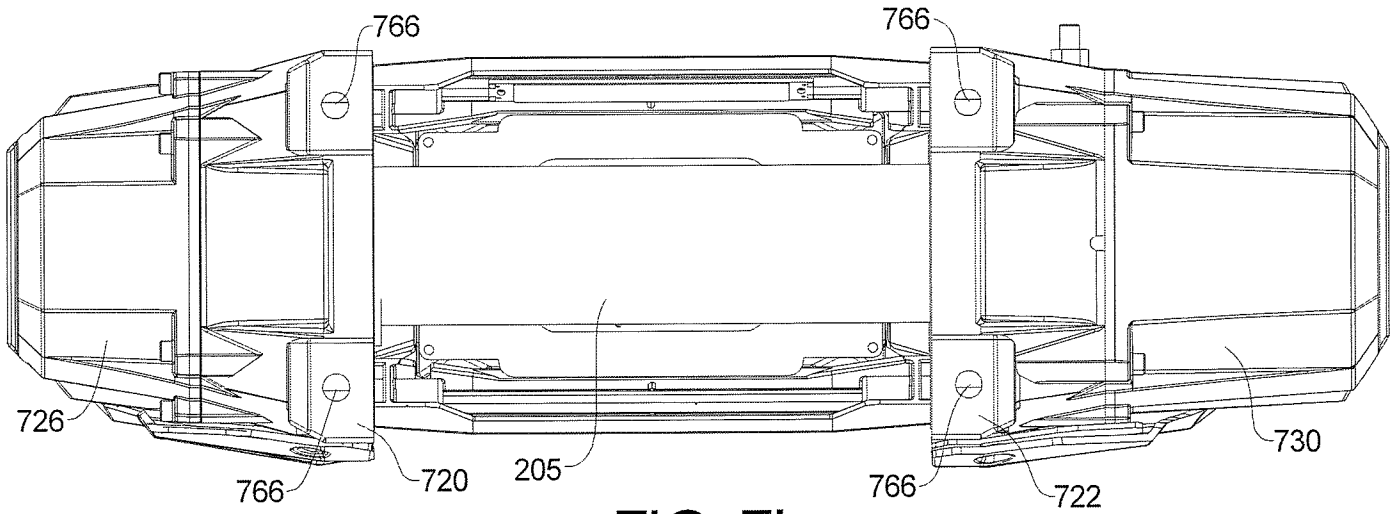
FIG. 7I is a bottom side view of the winch of FIG. 7A.
Figure 8A:
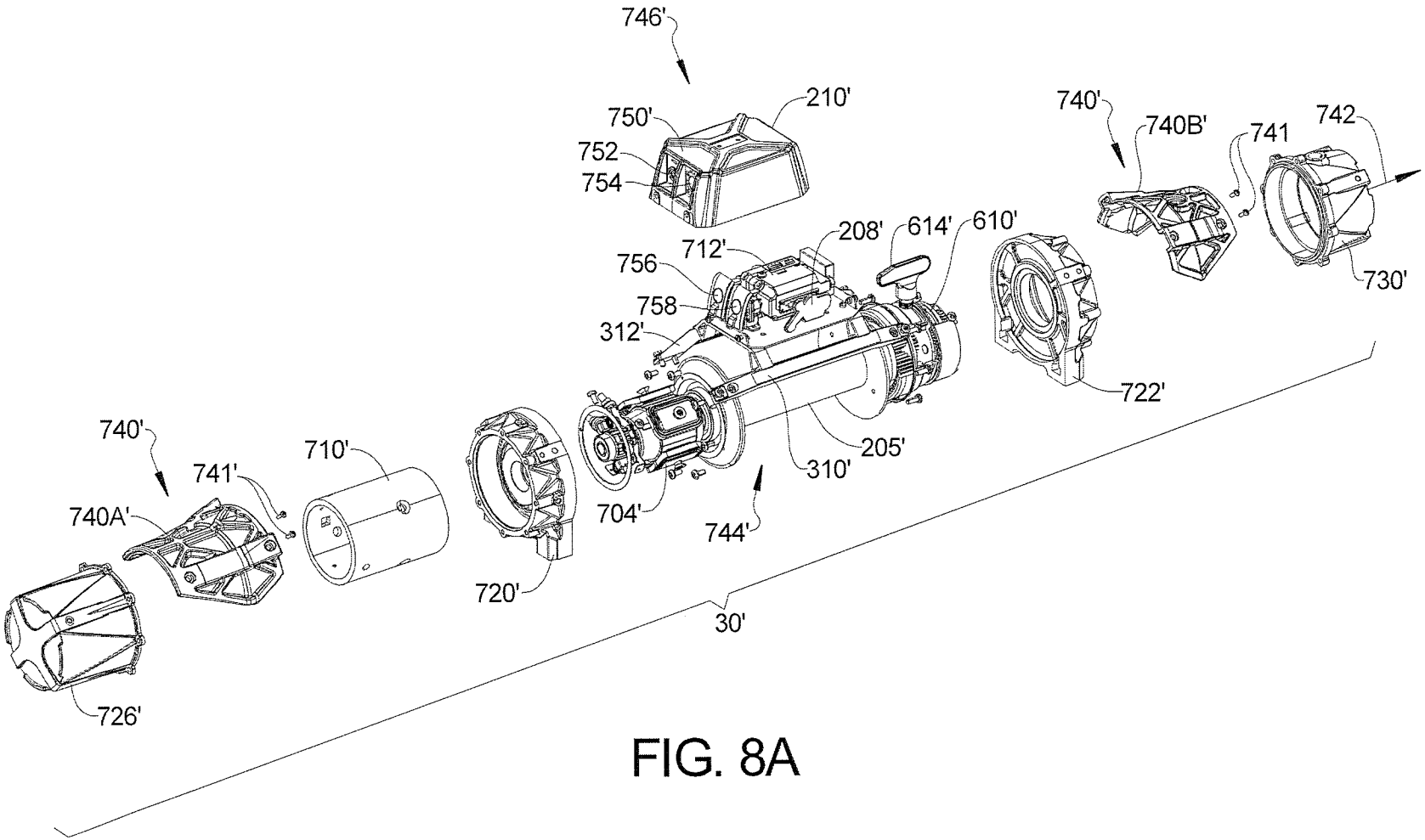
FIG. 8A is a detailed exploded view of a first example of the winch.
Figure 8B:
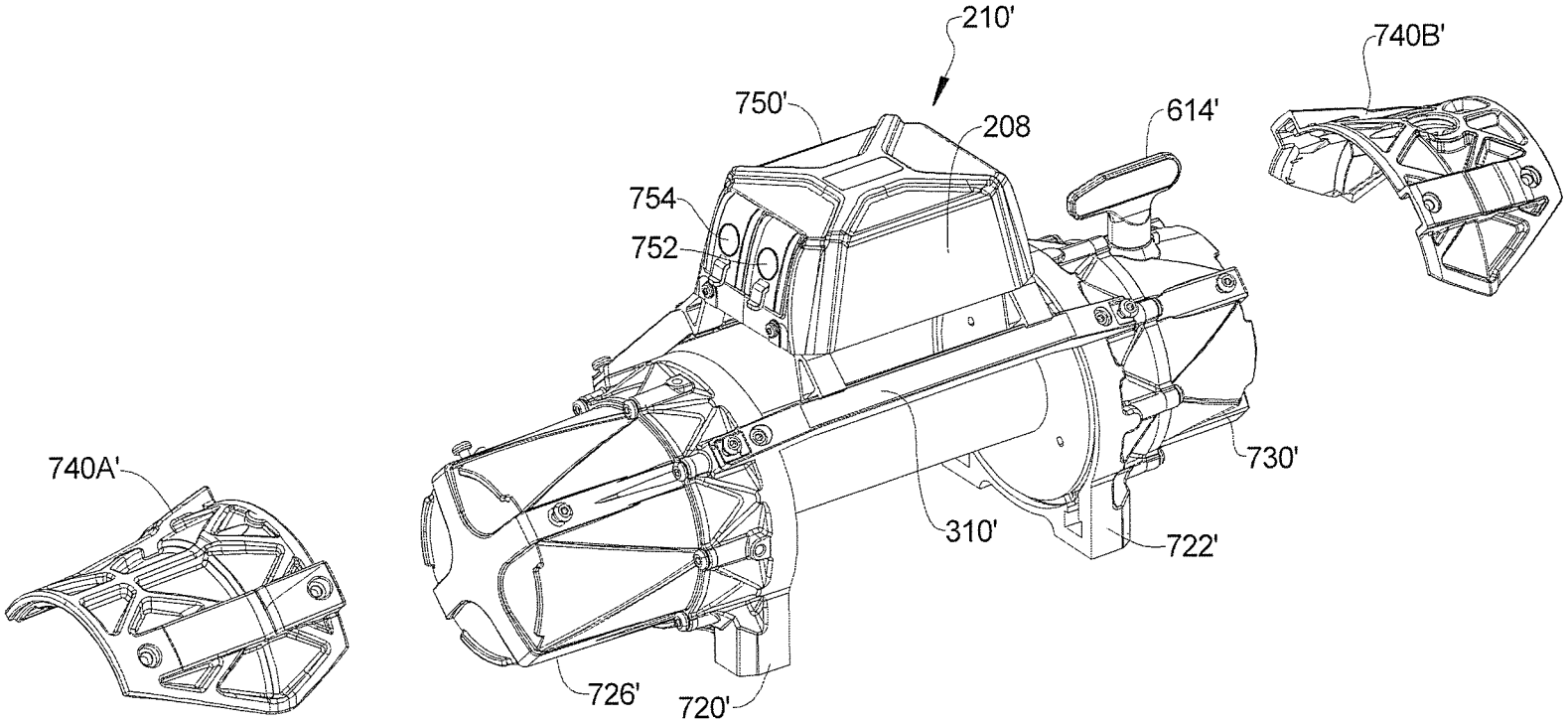
FIG. 8B is a partially exploded view of the winch.
Figure 8C:
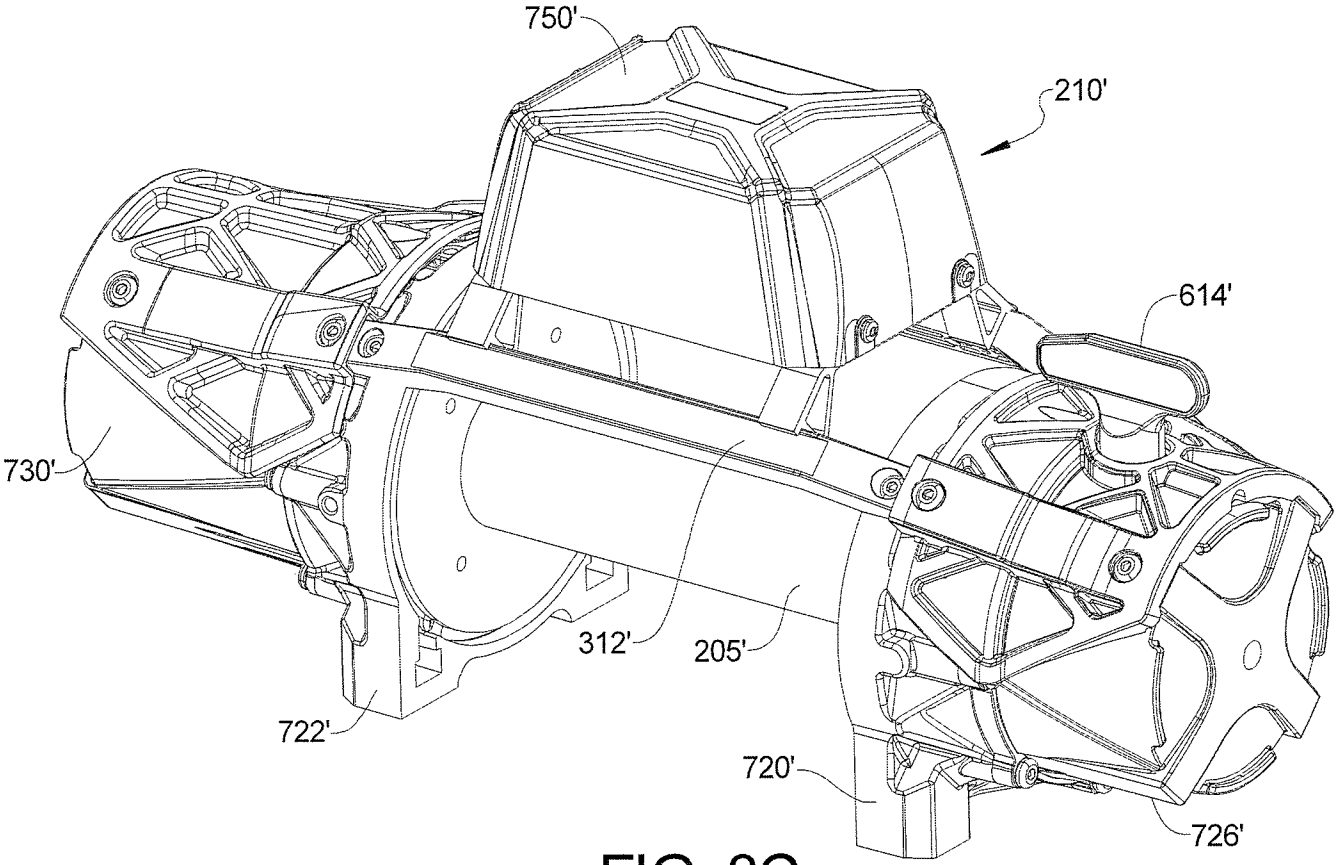
FIG. 8C is a perspective view of the winch of FIG. 8A.
Figure 8D:
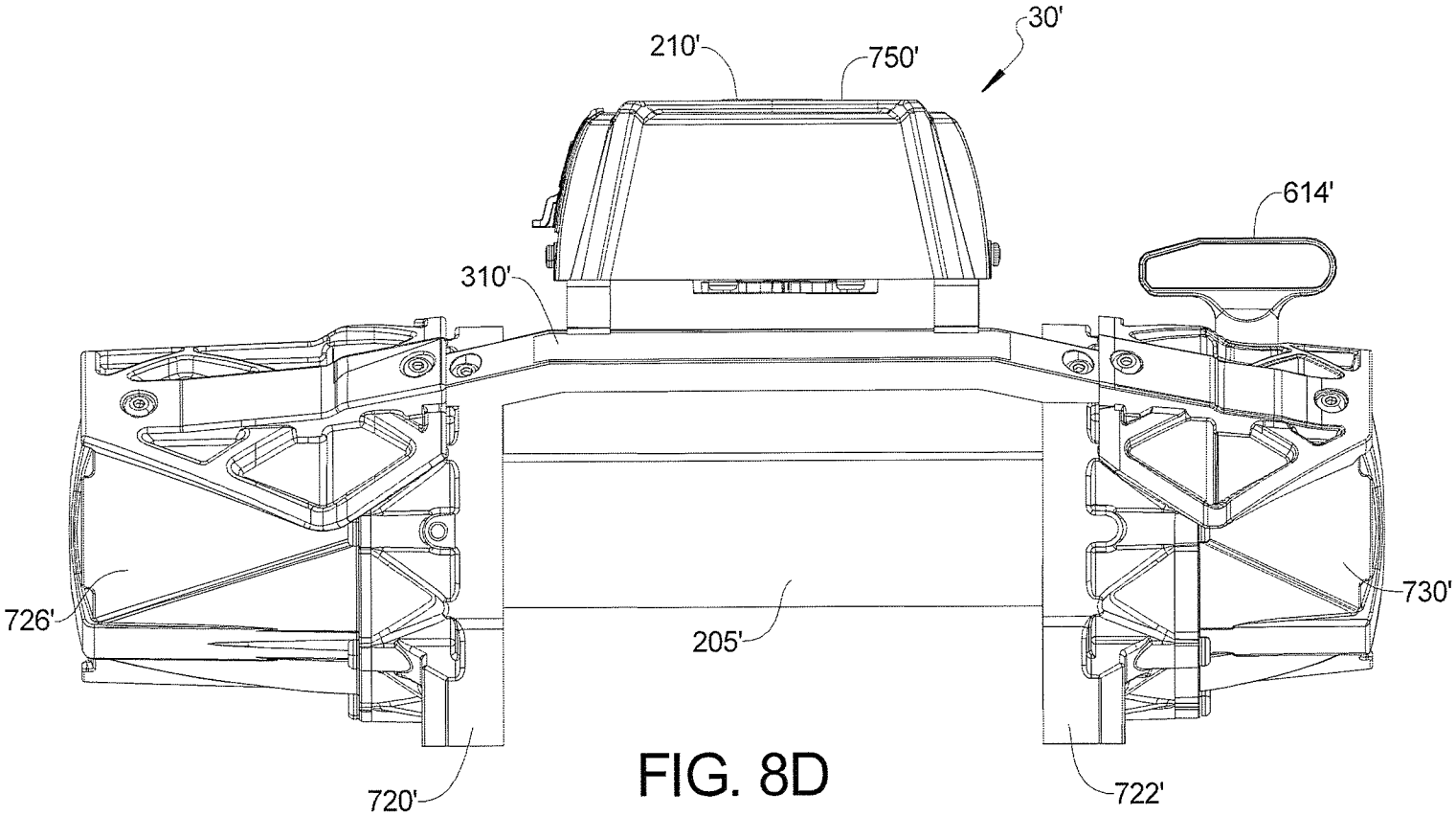
FIG. 8D is a front view of the winch for FIG. 8A.
Figure 8E:
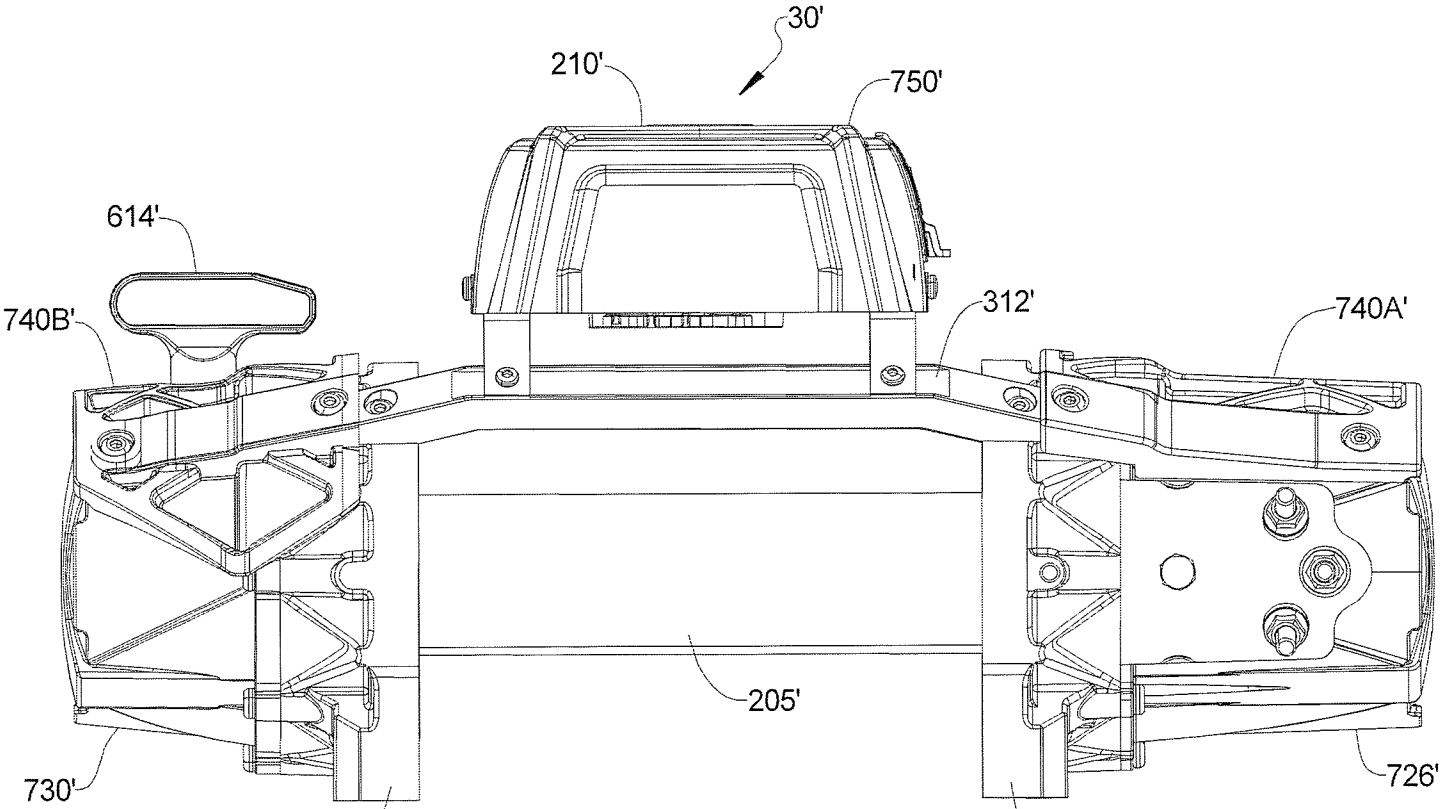
FIG. 8E is a back view of the winch of FIG. 8A.
Figure 8G:
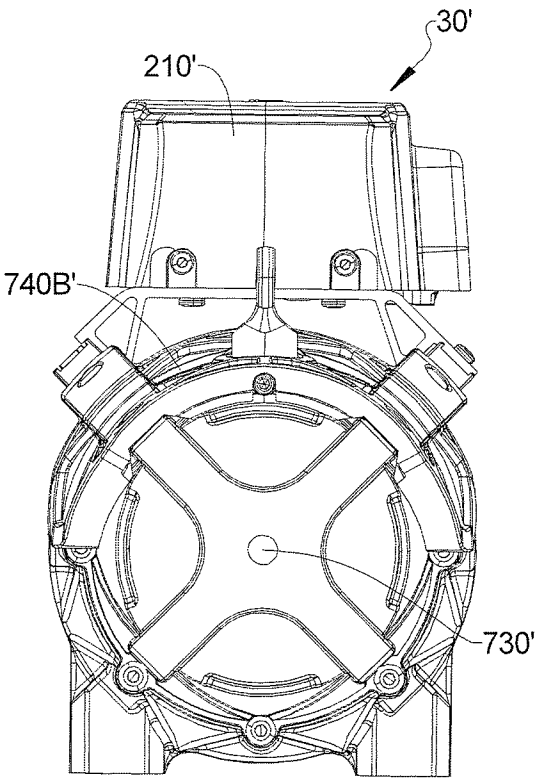
FIG. 8G is a left side view of the winch of FIG. 8A.
Figure 8F:
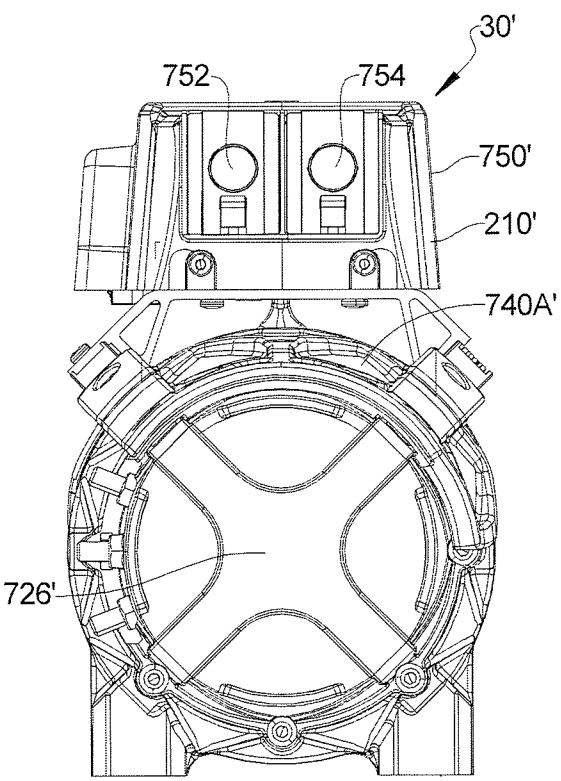
FIG. 8F is a right side view of the winch of FIG. 8A.
Figure 8H:
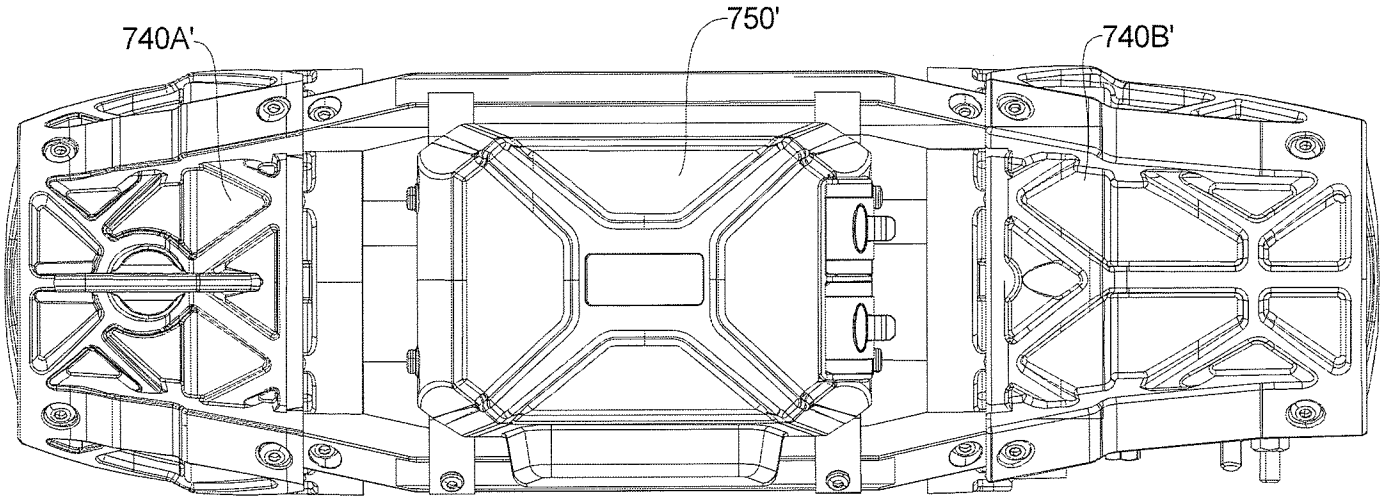
FIG. 8H is a top side view of the winch of FIG. 8A.
Figure 8I:
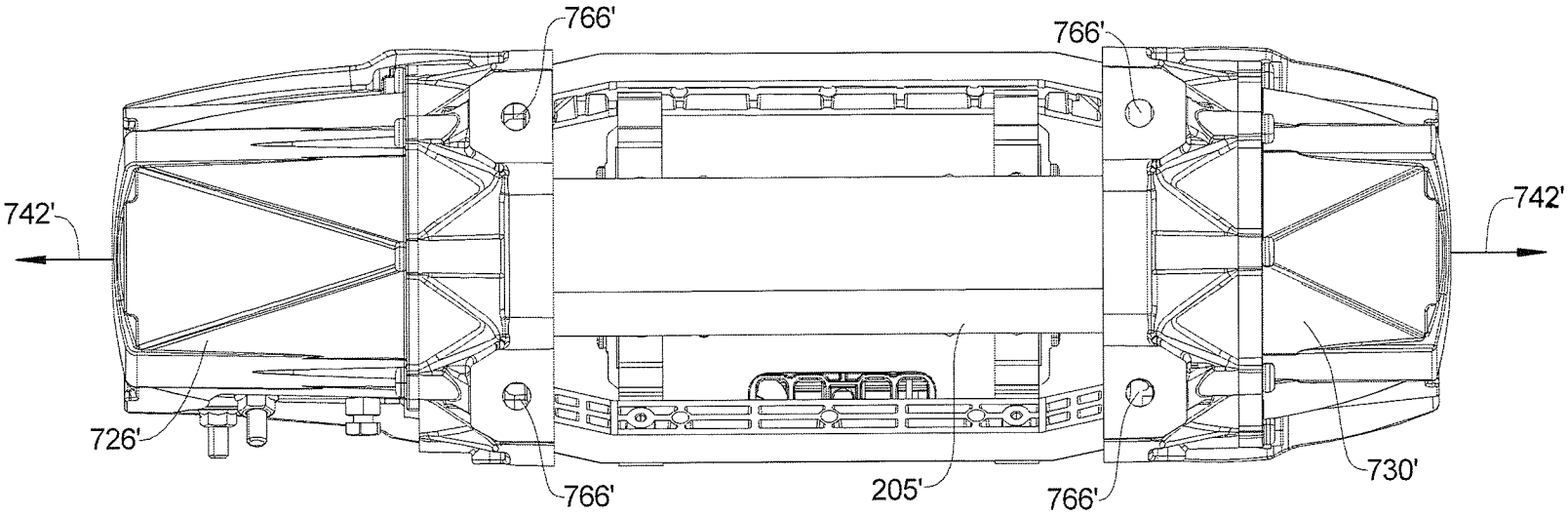
FIG. 8I is a bottom side view of the winch of FIG. 8A.

As is best shown in the bottom view of FIG. 7I, the first drum support 720 and the second drum support 722 may include mounting holes 766 used for receiving a screw, bolt or other fastener therethrough for securing the winch to the structure of the vehicle.

Figure 9A:
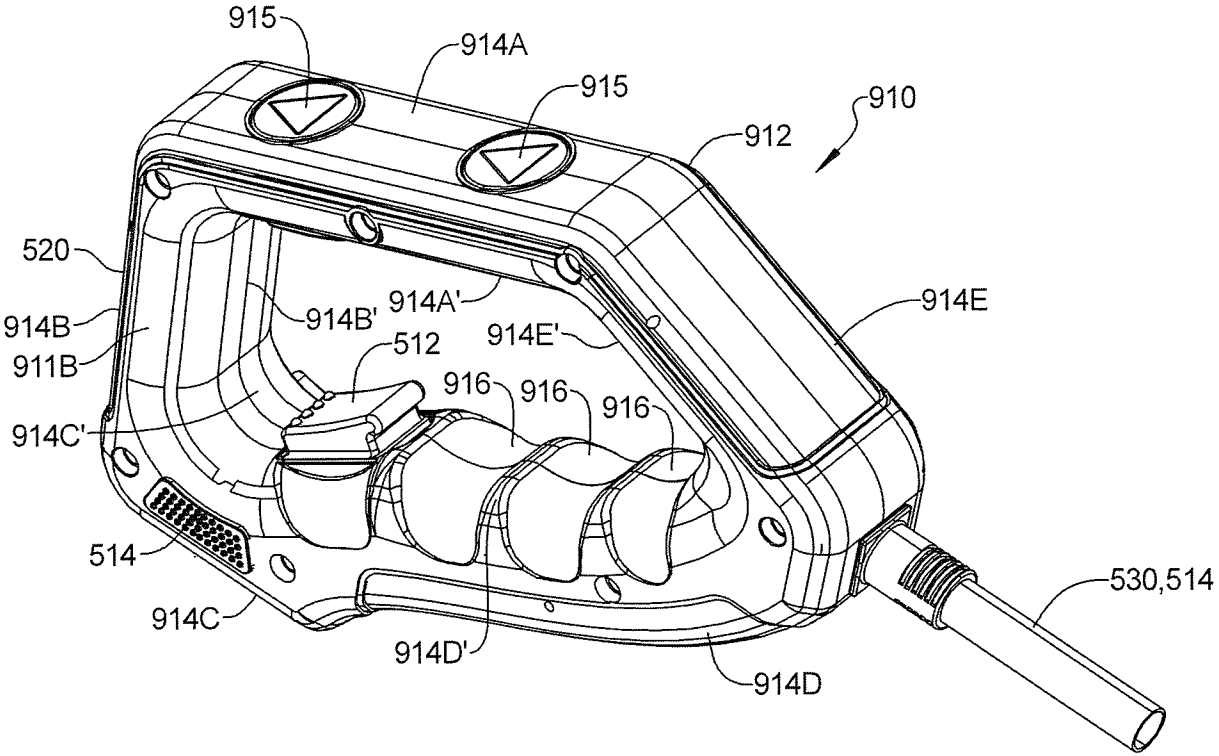
FIG. 9A is a perspective view of a winch remote control.
Figure 9B:
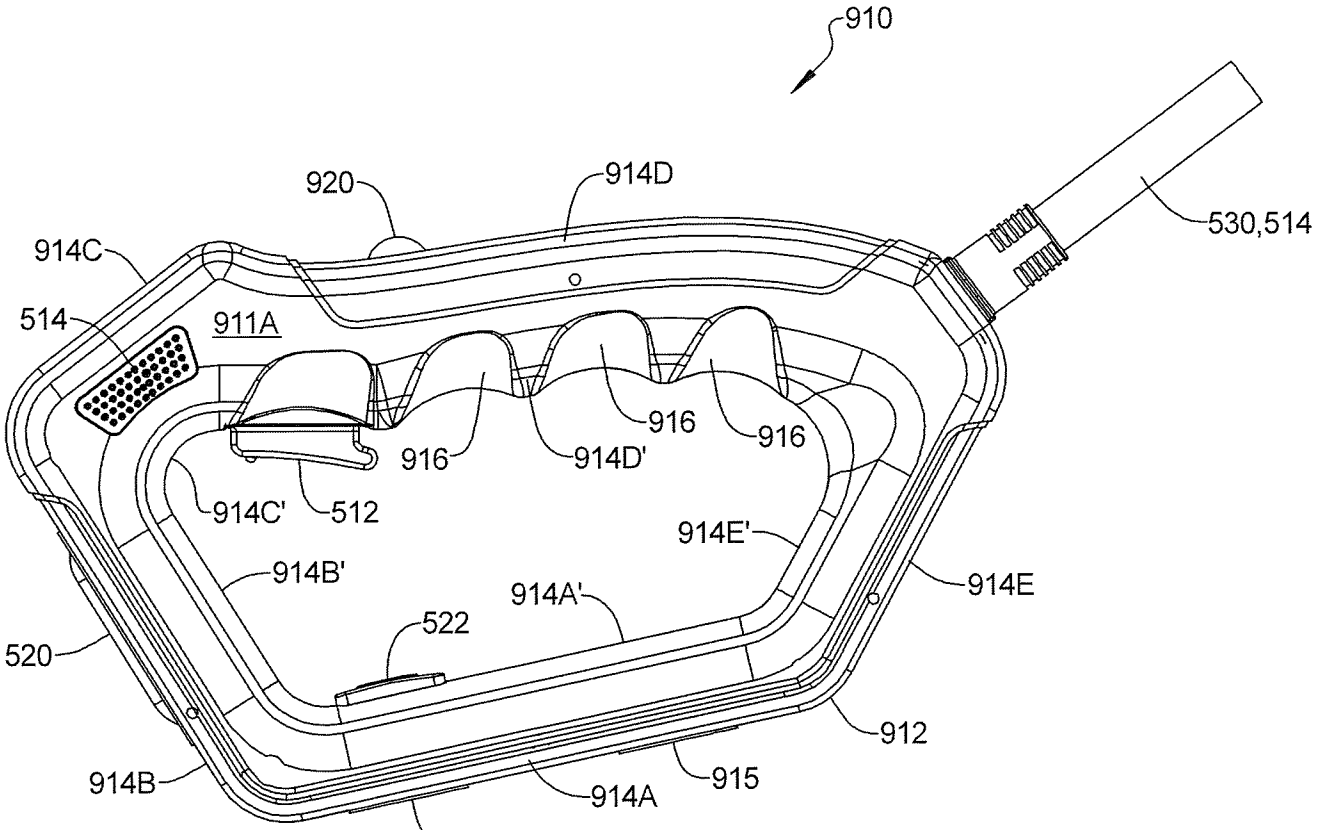
FIG. 9B is a front view of the winch remote control.
Figure 9D:
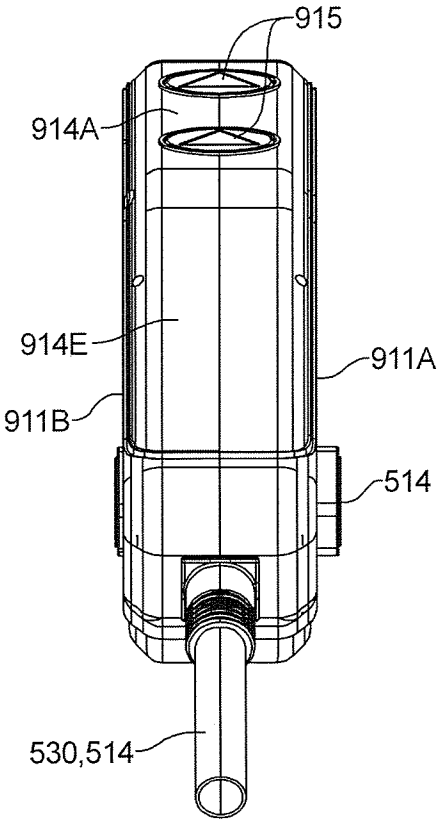
FIG. 9D is a right side view of the winch remote control.
Figure 9C:
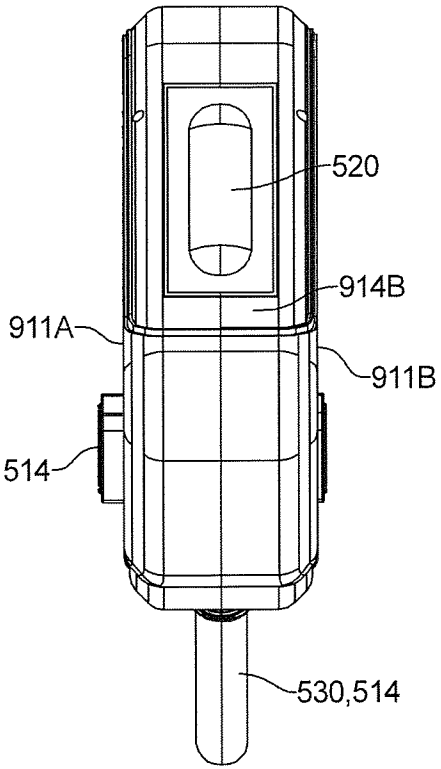
FIG. 9C is a left side view of the winch remote control.
Figure 9E:
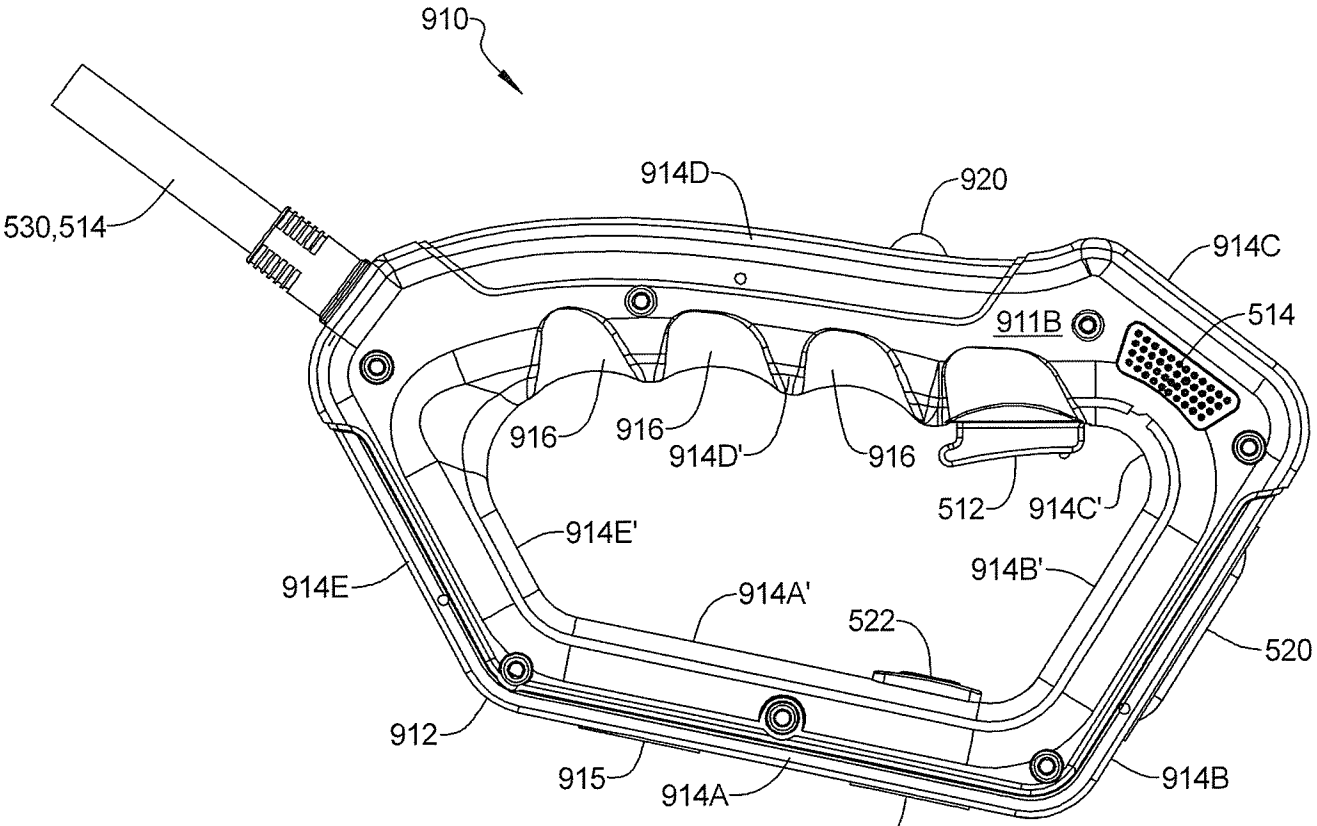
FIG. 9E is a rear side view of the winch remote control.
Figure 9F:
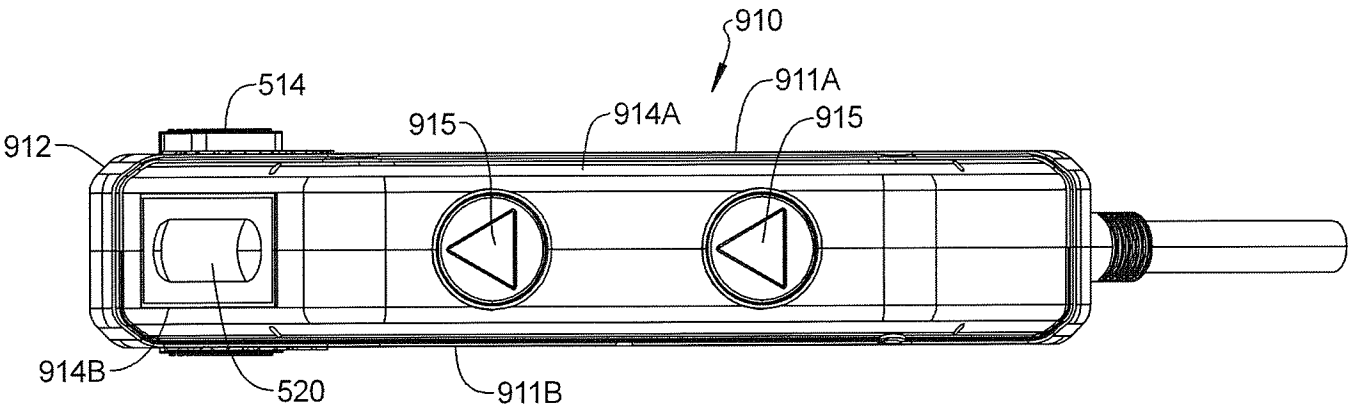
FIG. 9F is a bottom side view of the winch remote control.
Figure 9G:
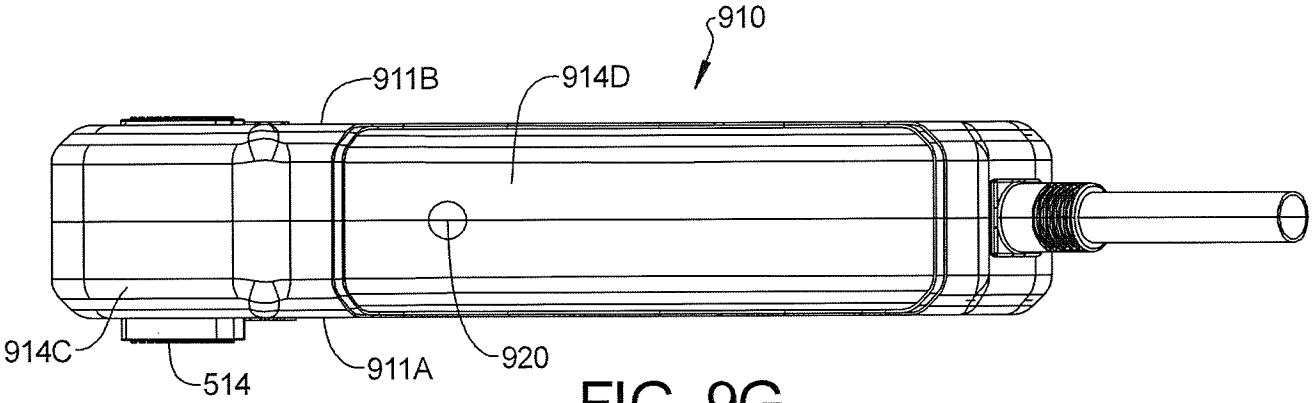
FIG. 9G is a top side view of the winch remote control.

Referring now to FIGS. 8A-8I the same components are referred to with prime compared to that set forth in FIGS. 7A-7I. In this example, the supplemental covers and in particular the supplemental covers 740A' and 740B' have a different configuration. In the configuration in FIGS. 8A-8I, the supplemental covers 740A' covers a portion of the top side, rear side and front side of the motor cover 726'. The gear side supplemental cover 740B' covers at least a portion of the top side, front side and rear side of the gear cover 730'. In this example the supplemental cover 740A' mounts to both the motor cover 726' and the first drum support 722'. The supplemental cover 740B' is fastened to the second drum support 722' and the gear cover 730'. The remainder of the components are functionally the same as FIGS. 7A-I Referring now to FIG. 9A, the wireless remote control 218 may be formed in a similar manner to the wired remote control and thus will be described collectively as the remote control 910 in FIGS. 9A-9D. FIGS. 9B and 9E show longitudinal exterior sides or walls of the remote control housing 912. FIGS. 9C, 90, F and 9G show lateral internal sides or walls of the housing 912. In this example, the remote control 910 may or may not include the wire 530 coupling the remote control 910 to the controller 200 illustrated above. Although, if a wireless remote control is used, the wire 530 may be replaced by the antenna 514. Although, in some embodiments the antenna 514 may be internal to the housing 912 of the remote control 910. In the present example, the housing 912 is formed of a plurality of sides. The housing 912 is a closed irregular polygon. The closed polygon has an interior that is sized to allow a hand of the operator to be inserted therein. The closed polygon has interior lateral surface, exterior lateral surfaces and a pair of longitudinal surface between which the lateral surfaces extend. In this example the remote control 910 includes five sides. Side 914A is used for holding a pair of magnets 915 on the exterior of the housing 912. Side 914B is a lateral side and has the light 520 disposed thereon. The light 520 may be activated by the light switch 522 and forms a flashlight.

Side 914C is also a lateral side and may house the winch direction switch 514. In this example, the winch direction switch 514 are disposed in longitudinal sides directly adjacent to the side 914C. The winch direction switch 514 may be slid in a direction perpendicular or lateral to the side 914C so that in one direction the winch turns the drum and in a first direction (wind) and while in a second direction turns the drum in the second direction (unwind). The winch direction switch 514 extends partially from one side corresponding to a first direction and out the other side in direction of the winch operating in a second direction.

Side 914D has a winch activation switch 512 coupled therein. That is, the winch activation switch 512 is within the interior of the generally hollow housing. The fourth side 914D may also have finger grips 916 for receiving a user's fingers so that the remote control 910 may be comfortably gripped. The outside of side 914D may have an indicator 920 indicating a load of the winch.

The fifth side 914E is used to connect the second side 914B and fourth 914D. Sides 914A-E may be referred to as lateral external sides. Sides 914A'-914E' may be referred to as lateral internal sides. Sides 911A and 911B are longitudinal sides between which the lateral internal and lateral external sides extend. The internal sides are internal to the polygon.

Figure 10:
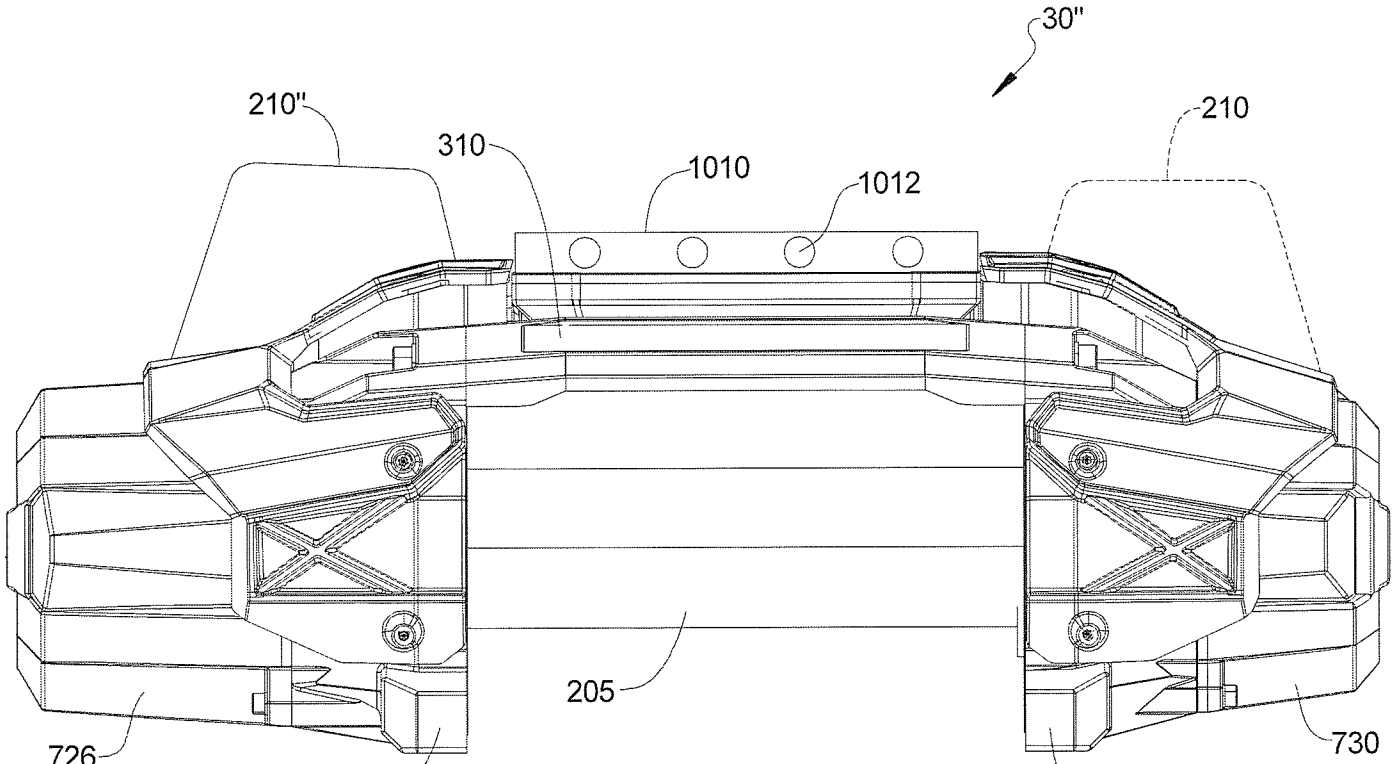
FIG. 10 is a simplified block diagrammatic view of an alternative method for mounting the contactor box.

Referring now to FIG. 10, a winch 30" is illustrated. In this example the contactor box 210" is illustrated mounted to the motor cover 726. The contactor box 210" may also be mounted to the gear cover 730. In this manner, a light bar 1010 may be coupled to the cross members 310 and 312 (not shown in FIG. 10). The light bar 1010 may include a plurality of light emitting diodes or other light sources 1012. The light sources 1012 may be used for illuminating the area in front of the vehicle 10. The light sources 1012 may be activated from within the vehicle through a light switch. In a similar manner to the switching used for a daytime running light.

Figure 11:
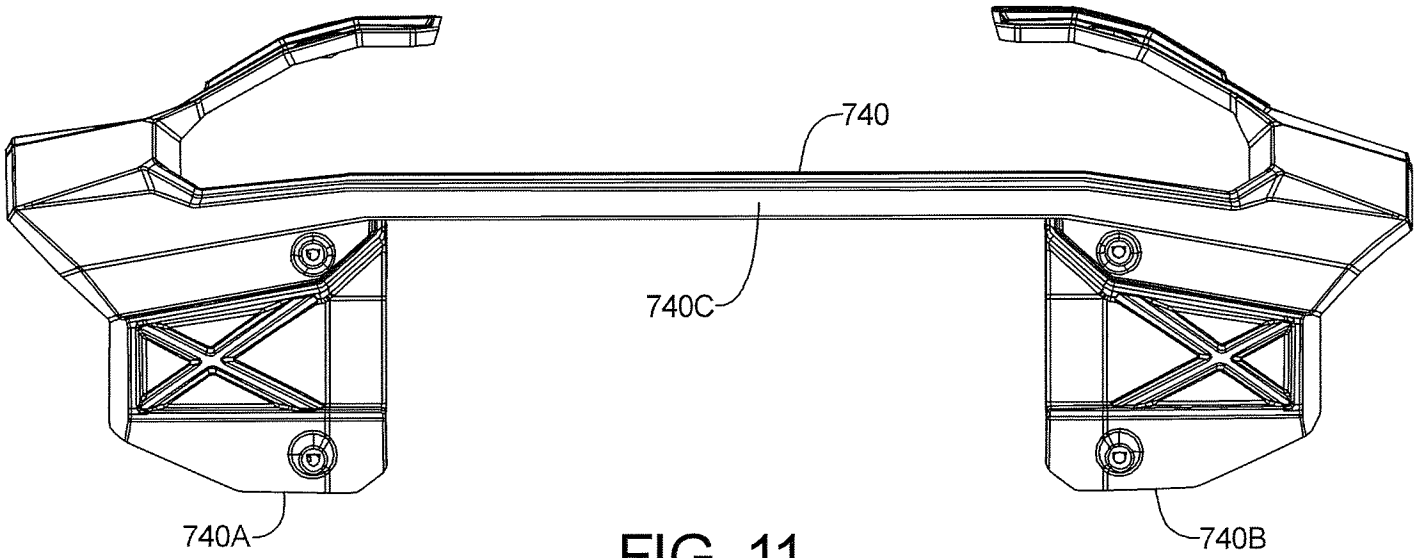
FIG. 11 is a top view of an alternative cover formed as a single component.

FIG. 11 is a top view of a cover 740 having the supplemental cover 740A and the supplemental cover 740B connected by a third portion 740C. The portion 740C may be positioned in front, behind, or under the winch. The cover 740A, cover 740B and third portion 740C may be integrally molded or formed as a monolithic structure.

Examples are provided so that this disclosure will be thorough, and will fully convey the scope to those who are skilled in the art. Numerous specific details are set forth such as examples of specific components, devices, and methods, to provide a thorough understanding of examples of the present disclosure. It will be apparent to those skilled in the art that specific details need not be employed, that examples may be embodied in many different forms and that neither should be construed to limit the scope of the disclosure. In some examples, well-known processes, well-known device structures, and well-known technologies are not described in detail.

The foregoing description has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A winch comprising:

a winch body having, a first drum support;

a second drum support;

a drum rotatably coupled to the first drum support and the second drum support;

a plurality of gears coupled to the second drum support and the drum;

a motor coupled to the drum through the plurality of gears;

a motor cover coupled to the first drum support;

a gear cover coupled to the second drum support and houses the plurality of gears therein; and a supplemental cover comprising a first cover covering at least a portion of the motor cover and comprising a second cover covering at least a portion of the gear cover, the first cover is directly coupled to the first drum support and the motor cover using fasteners and the second cover is directly coupled to the second drum support and the gear cover using fasteners.

2. The winch as recited in claim 1 wherein the supplemental cover covers at least a forward facing portion of the gear cover and motor cover relative to a vehicle.

3. The winch as recited in claim 1 wherein the supplemental cover covers at least a forward facing portion and a top facing portion of the gear cover and motor relative to a vehicle.

4. The winch as recited in claim 1 further comprising a gear release handle decoupling the drum from the gears or motor, said gear release handle having a first side and a second side, said first side having first indicia corresponding to the drum engaged with the gears and a second indicia corresponding to the drum disengaged with the gears.

5. The winch as recited in claim 4 wherein the first side and the second side are disposed in a first plane that is forward facing relative to a vehicle such that the first side is forward facing when the gear release handle is in a first position engaging the gears and the second side is forward facing when the gear release handle is in a second position disengaging the gears.

6. The winch as recited in claim 5 wherein the first plane is parallel to a longitudinal axis of the winch in the first position and the second position.

7. The winch as recited in claim 1 further comprising a contactor box comprising a controller therein, said controller coupled to the winch body and providing power to the motor.

8. The winch as recited in claim 7 wherein the controller within the contactor box is coupled to daytime running lights.

9. The winch as recited in claim 7 wherein the contactor box is coupled to a drum light illuminating the drum.

10. The winch as recited in claim 9 wherein the contactor box is mounted to a first crossbar and a second crossbar, said first crossbar and said second crossbar are mounted to the first drum support and the second drum support.

11. The winch as recited in claim 10 further comprising at least one drum illuminating light coupled to the first crossbar or the second crossbar.

* * * * *